US010241464B2

(12) United States Patent
Ao

(10) Patent No.: US 10,241,464 B2
(45) Date of Patent: Mar. 26, 2019

(54) IMAGE FORMING APPARATUS HAVING TWO OPENING AND CLOSING PORTIONS

(71) Applicant: FUJI XEROX CO., LTD., Tokyo (JP)

(72) Inventor: Satoshi Ao, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/344,694

(22) Filed: Nov. 7, 2016

(65) Prior Publication Data

US 2017/0371294 A1 Dec. 28, 2017

(30) Foreign Application Priority Data

Jun. 28, 2016 (JP) ..... 2016-128056
Jun. 28, 2016 (JP) ..... 2016-128057

(51) Int. Cl.

| | |
|---|---|
| ***G03G 21/16*** | (2006.01) |
| ***G03G 15/00*** | (2006.01) |
| ***B65H 1/04*** | (2006.01) |
| ***B65H 5/06*** | (2006.01) |

(52) U.S. Cl.

CPC ..... *G03G 21/1633* (2013.01); *B65H 1/04* (2013.01); *B65H 5/062* (2013.01); *G03G 15/6514* (2013.01); *B65H 2402/10* (2013.01); *B65H 2402/441* (2013.01); *B65H 2404/144* (2013.01); *B65H 2404/152* (2013.01); *B65H 2405/324* (2013.01); *B65H 2407/21* (2013.01); *G03G 2221/1684* (2013.01)

(58) Field of Classification Search

CPC ..... G03G 21/1633; G03G 21/1638
See application file for complete search history.

(56) References Cited

U.S. PATENT DOCUMENTS 5,418,606 A * 5/1995 Kikuchi ..... G03G 15/326 399/381
8,494,408 B2 7/2013 Nakano et al.
8,620,175 B2 12/2013 Nakano et al.
9,170,553 B2 10/2015 Nakano et al.
(Continued)

FOREIGN PATENT DOCUMENTS

JP 2006337477 A 12/2006
JP 2011248135 A 12/2011
JP 2015141228 A 8/2015

*Primary Examiner* — David Bolduc
(74) *Attorney, Agent, or Firm* — Sughrue Mion, PLLC

(57) ABSTRACT

An image forming apparatus includes: a first opening/closing member that can move between a first opening position in which the first opening/closing member opens an inside of a body of the image forming apparatus, and a first closing position in which the first opening/closing member closes the inside of the body of the image forming apparatus; a second opening/closing member that can move around a rotation shaft and between a second closing position in which the second opening/closing member closes an opening formed in the first opening/closing member, and a second opening position in which the second opening/closing member opens the opening, the second opening/closing member being removably attached to the body of the image forming apparatus; and a supported portion that is provided in the first opening/closing member so as to be supported on a support portion of the second opening/closing member, as defined herein.

19 Claims, 21 Drawing Sheets

(56) References Cited

U.S. PATENT DOCUMENTS

| | | | | |
|---|---|---|---|---|
| 2004/0190934 | A1* | 9/2004 | Okabe | G03G 15/6502 399/111 |
| 2005/0019058 | A1* | 1/2005 | Hirose | G03G 21/1633 399/110 |
| 2011/0001284 | A1* | 1/2011 | Ohtsuki | B65H 5/26 271/162 |
| 2011/0135368 | A1* | 6/2011 | Yamamoto | B65H 3/44 400/578 |
| 2011/0293316 | A1* | 12/2011 | Sato | G03G 15/6558 399/101 |
| 2011/0293317 | A1 | 12/2011 | Nakano et al. | |
| 2013/0011174 | A1* | 1/2013 | Lee | G03G 21/1633 399/381 |
| 2013/0251396 | A1* | 9/2013 | Shikata | G03G 21/1633 399/110 |
| 2013/0279959 | A1 | 10/2013 | Nakano et al. | |
| 2014/0086637 | A1 | 3/2014 | Nakano et al. | |
| 2015/0307307 | A1* | 10/2015 | Goto | G03G 21/1623 399/13 |

* cited by examiner

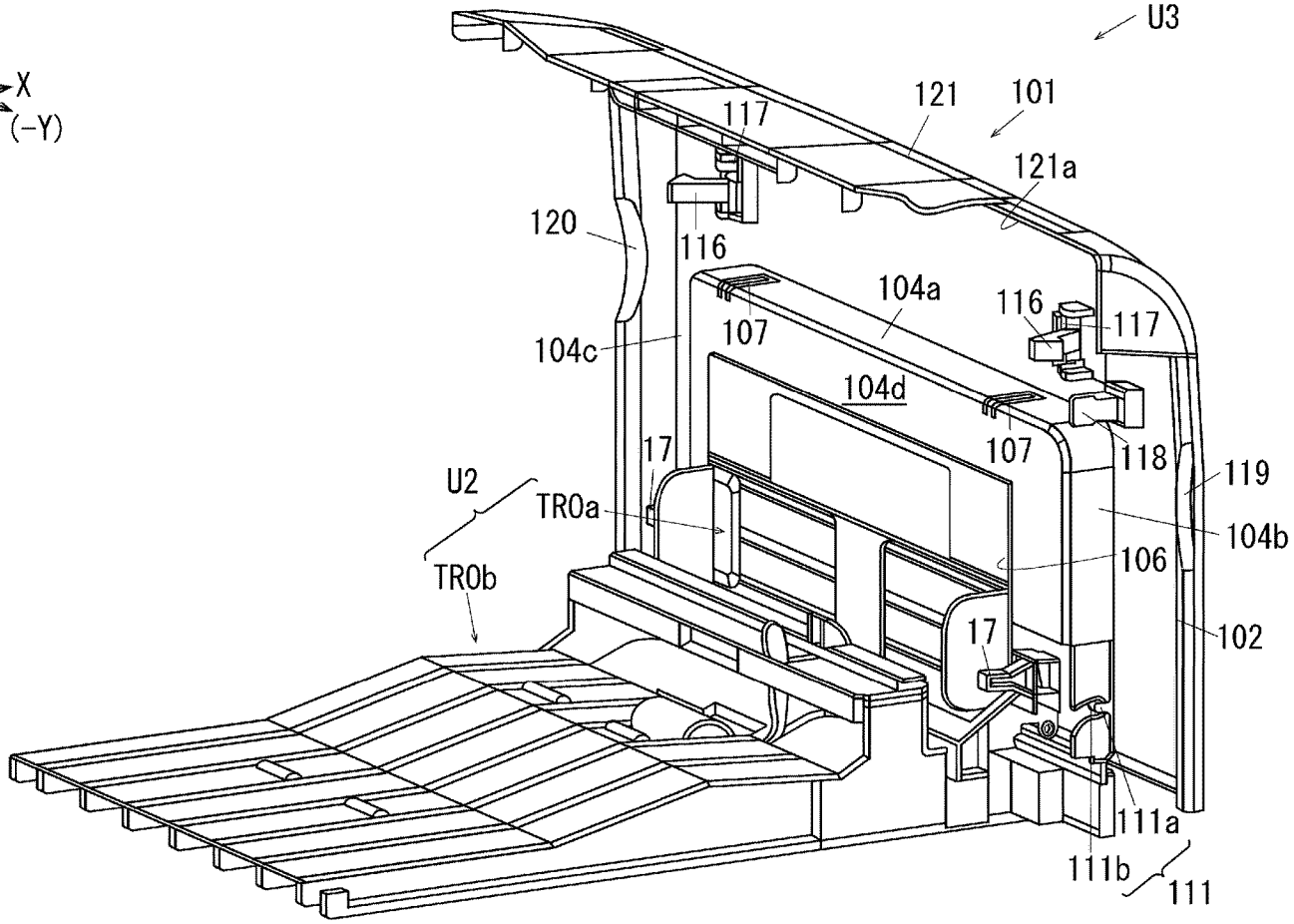
FIG. 17
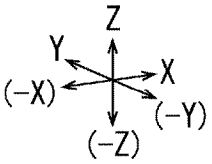

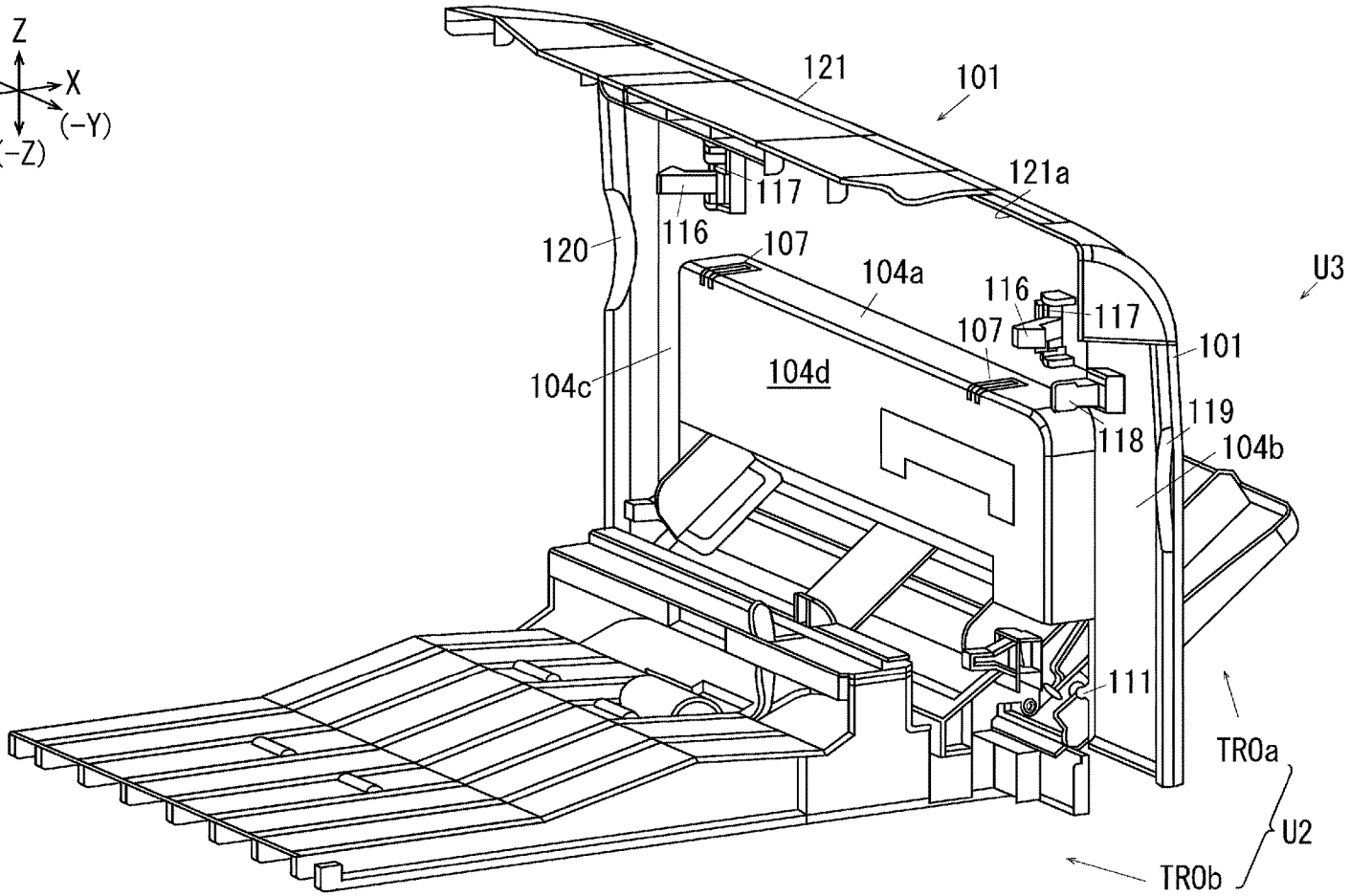
FIG. 20
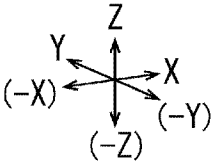

IMAGE FORMING APPARATUS HAVING TWO OPENING AND CLOSING PORTIONS

CROSS-REFERENCE TO RELATED APPLICATIONS

This application is based on and claims priority under 35 USC 119 from Japanese Patent Application No. 2016-128056 filed on Jun. 28, 2016, and Japanese Patent Application No. 2016-128057 filed on Jun. 28, 2016.

BACKGROUND

Technical Field

The present invention relates to an image forming apparatus.

SUMMARY

According to an aspect of the invention, there is provided an image forming apparatus comprising: a first opening/closing member that can move between a first opening position in which the first opening/closing member opens the inside of a body of the image forming apparatus, and a first closing position in which the first opening/closing member closes the inside of the body of the image forming apparatus; a second opening/closing member that can move around a rotation shaft and between a second closing position in which the second opening/closing member closes an opening formed in the first opening/closing member, and a second opening position in which the second opening/closing member opens the opening, the second opening/closing member being removably attached to the body of the image forming apparatus; and a supported portion that is provided in the first opening/closing member so as to be supported on a support portion of the second opening/closing member, the supported portion being engaged with the support portion in the first opening position so that the first opening/closing member can move together with the second opening/closing member.

BRIEF DESCRIPTION OF THE DRAWINGS

Exemplary embodiments of the present invention will be described in detail based on the following figures, wherein:

FIG. 17 is a perspective view of the removable unit in Example 1, which is an explanatory view showing a case where the front cover has been moved to a closing position;

FIG. 20 is an explanatory view corresponding to FIG. 19 and showing a case where the removable unit is observed from the rear;

FIG. 21A is an explanatory view showing a case where the manual feed tray and the front cover have been moved to the closing position; FIG. 21B is an explanatory view showing a case where the manual feed tray has been moved to the manual feed position; and FIG. 21C is an explanatory view showing a case where the front cover has been moved to the working position.

DETAILED DESCRIPTION

Figure 1:
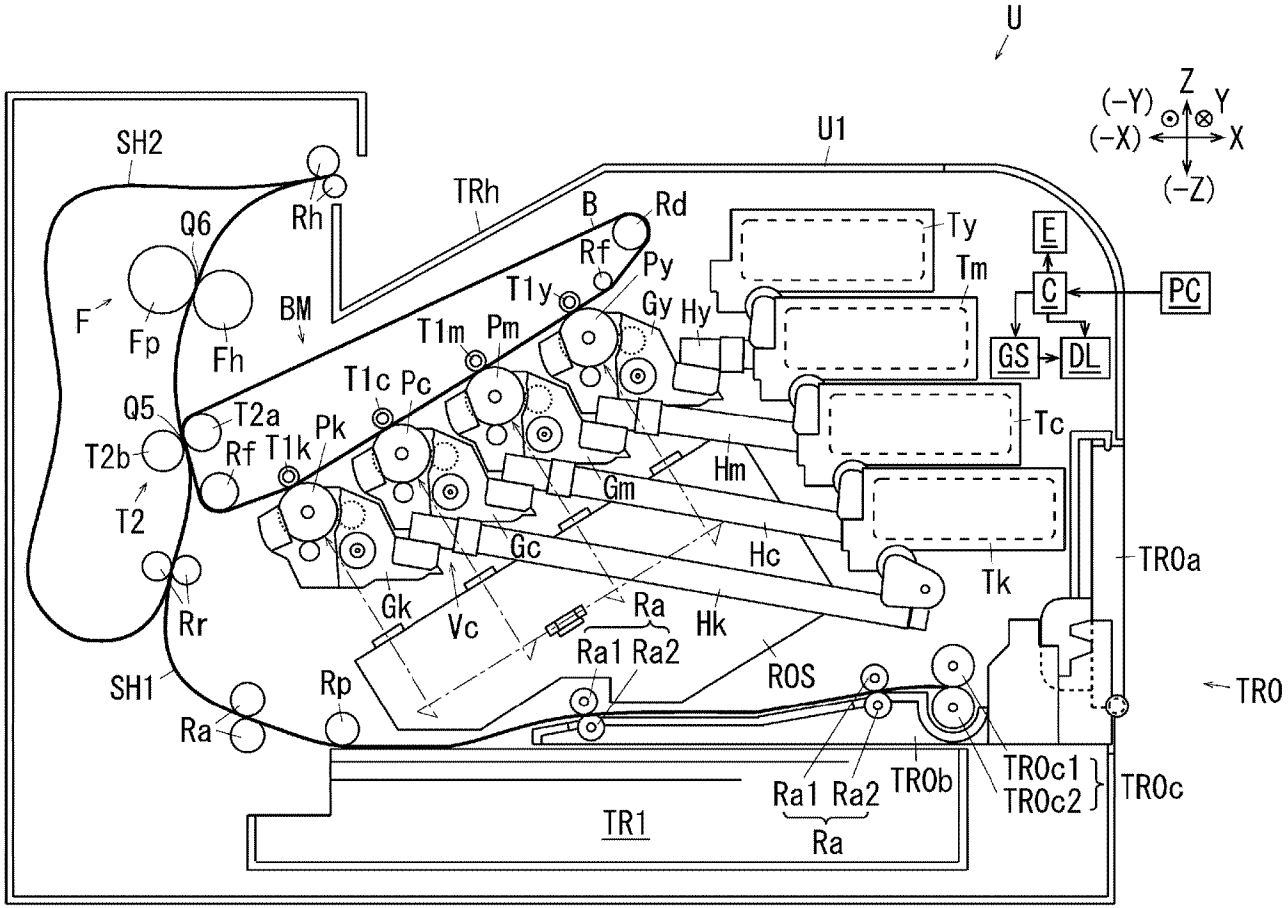
FIG. 1 is an explanatory view of a printer according to Example 1 of the invention.

An example which is a specific example of an exemplary embodiment of the invention will be described below with reference to the drawings. However, the invention is not limited to the following example.

Incidentally, in order to make it easy to understand the following description, in the drawings, define the front/rear direction as an X-axis direction, the left/right direction as a Y-axis direction, and the up/down direction as a Z-axis direction, and define directions or sides designated by arrows X, -X, Y, -Y, Z and -Z as a front direction, a rear direction, a right direction, a left direction, an upper direction and a lower direction, or a front side, a rear side, a right side, a left side, an upper side and a lower side respectively.

In addition, in the drawings, an arrow with "." inside "o" designates an arrow from the back of the paper toward the front of the same, and an arrow with "x" inside "o" designates an arrow from the front of the paper toward the back of the same.

Incidentally, illustration of any other member than members required for description for easiness to understand is omitted suitably in the following description using the drawings.

EXAMPLE 1

FIG. 1 is an explanatory view of a printer in Example 1 of the invention.

In FIG. 1, a printer U in Example 1 of an image forming apparatus according to the invention includes an apparatus body U1. A discharge tray TRh as an example of a paper discharge portion is provided in an upper surface of the apparatus body U1.

In FIG. 1, a controller C, an image processing portion GS, a writing drive circuit DL as an example of a drive circuit of a latent image forming unit, a power supply circuit E as an example of a power supply unit, etc. are built in the printer U. Incidentally, in Example 1, the controller C etc. are implemented by a microcomputer constituted by a not-shown control board. In addition, the controller C is electrically connected to a personal computer PC as an example of an information processing apparatus.

Figure 2:
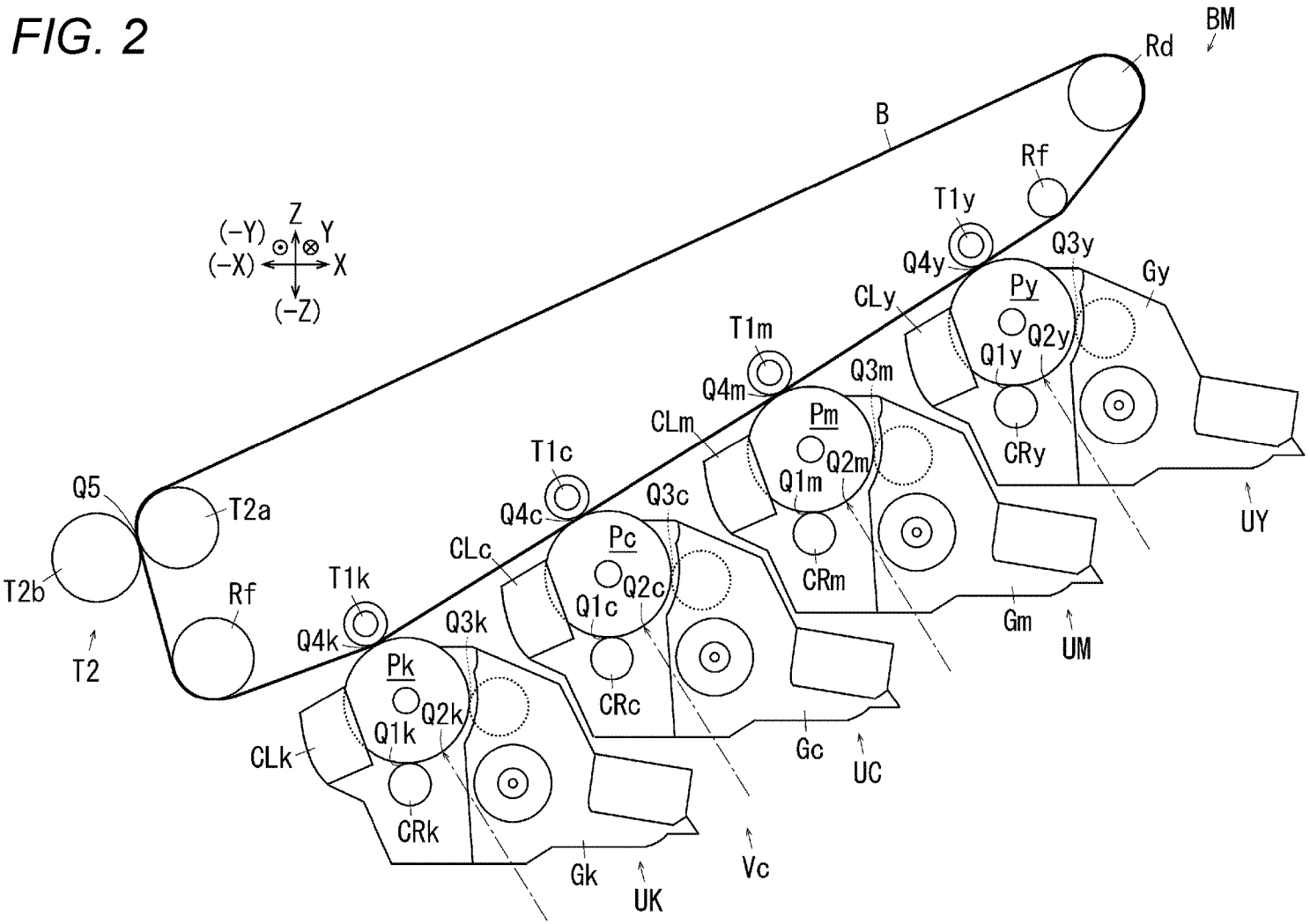
FIG. 2 is an explanatory view of an image forming portion in the printer according to Example 1.

FIG. 2 is an explanatory view showing an image forming portion of the printer in Example 1.

In FIG. 1 and FIG. 2, image forming units UY, UM, UC and UK as an example of visible image forming units are disposed under the discharge tray TRh of the printer U.

In FIG. 1, the image forming unit UK for black, that is, a color K includes a photoreceptor Pk as an example of an image holder. A charging roller CRk as an example of a charger, a developing unit Gk, a photoreceptor cleaner CLk as an example of a cleaner for an image holder, etc. are disposed around the photoreceptor Pk. A latent image forming unit ROS is disposed under the developing units Gy to Gk.

The image forming units UY, UM and UC for the other colors are arranged in the same manner as the black image forming unit UK.

Toner cartridges Ty, Tm, Tc and Tk as an example of developer containment vessels are removably supported on a front portion of the apparatus body U1. The toner cartridges Ty to Tk are connected to the developing units Gy to Gk through developer supply units Hy, Hm, Hc and Hk respectively.

In FIG. 1, a belt module BM as an example of an intermediate transfer unit is disposed above the photoreceptors Py to Pk. The belt module BM is an example of an image holder, which includes an intermediate transfer belt B as an example of an intermediate transferor.

The intermediate transfer belt B is supported rotatably by an intermediate transfer support system, which is constituted by a belt drive roll Rd as an example of a driving member, a backup roll T2*a* as an example of a secondary transfer opposed member, a plurality of driven rollers Rf as an example of driven members, and primary transfer rollers T1*y*, T1*m*, T1*c* and T1*k* as an example of primary transfer units.

Primary transfer areas Q4*y*, Q4*m*, Q4*c* and Q4*k* are formed by areas where the photoreceptors Py to Pk face the primary transfer rollers T1*y* to T1*k* respectively.

A secondary transfer roll T2*b* as an example of a secondary transfer member is disposed to face the surface of the intermediate transfer belt B abutting against the backup roll Ta.

A secondary transfer unit T2 is constituted by the backup roll T2*a* and the secondary transfer roll T2*b*. In addition, a secondary transfer area Q5 is formed by an area where the secondary transfer roll T2*b* and the intermediate transfer belt B face each other.

A transfer unit T1+T2+B in Example 1 is constituted by the primary transfer rollers T1*y* to T1*k*, the intermediate transfer belt B, the secondary transfer unit T2, etc.

A manual feed tray TR0 as an example of a loading portion for a medium is disposed on the lower front side of the latent image forming unit ROS.

A tray body TR0*a* as an example of a body of the loading portion is openably/closably supported on the front end of the manual feed tray TR0. A conveyance portion TR0*b* extending rearward is connected to the rear of the tray body TR0*a*. A plurality of conveyance rolls Ra as an example of conveyance members for a medium are disposed in the conveyance portion TR0*b*.

A paper feed tray TR1 as an example of a loading portion for media is disposed under the manual feed tray TR0. The paper feed tray TR1 is supported removably in the front/rear direction relatively to the apparatus body U1. The paper feed tray TR1 is arranged so that it can be loaded with recording sheets S as an example of media.

A paper feed roll Rp as an example of a feeding member is disposed at the rear of the paper feed tray TR1. A conveyance roll Ra as an example of a conveyance member is disposed at the rear of the paper feed roll Rp. Incidentally, when a recording sheet S is conveyed from the manual feed tray TR0, the paper feed roll Rp and the conveyance roll Ra in Example 1 also serve as rolls for conveying the recording sheet S toward the downstream.

A registration roll Rr as an example of an adjustment member for adjusting a paper feed timing is disposed on the rear upper side of the conveyance roll Ra. A paper feed path SH1 as an example of a medium conveyance path is formed between the paper feed roll Rp and the registration roll Rr.

A fixing unit F is disposed above the secondary transfer unit T2. The fixing unit F includes a heating roll Fh as an example of a heating/fixing member, and a pressure roll Fp as an example of a pressure fixing member. A fixing area Q6 is formed by an area where the heating roll Fh and the pressure roll Fp can contact with each other at a pressure set in advance.

A discharge roller Rh as an example of a discharge member is disposed on the front upper side of the fixing unit F.

An inversion path SH2 as an example of a conveyance path extends behind the discharge roller Rh. The inversion path SH2 extends rearward from the discharge roller Rh and then extends downward behind the fixing unit F, the secondary transfer unit T2 and the registration roll Rr. The inversion path SH2 joins the upstream side of the registration roll Rr in the sheet conveyance direction. Incidentally, not-shown medium conveyance members are disposed in the inversion path SH2.

(Function of Image Forming Apparatus)

In the printer U according to Example 1, the controller C receives print information when the print information is transmitted from the personal computer PC to the printer U.

The controller C controls operations of the image processing portion GS, the writing drive circuit DL, and the power supply circuit E.

The print information received by the controller C is inputted to the image processing portion GS. The image processing portion GS converts the print information into image information for forming latent images corresponding to images of four colors of yellow, magenta, cyan and black, that is, Y, M, C and K. The image processing portion GS outputs the converted image information to the writing drive circuit DL at a timing set in advance.

Incidentally, when a manuscript image is a single-color image, that is, a monochromatic image, only the image information of black is inputted to the writing drive circuit DL.

The writing drive circuit DL includes not-shown drive circuits for the respective colors Y, M, C and K. The writing drive circuit DL outputs a signal corresponding to the inputted image information to the latent image forming unit ROS at a timing set in advance.

As soon as an image forming operation is started, the power supply circuit E applies voltages to the charging rollers CRy to CRk, the developing units Gy to Gk, the primary transfer rollers T1*y* to T1*k*, the secondary transfer roller T2*b*, etc. at timings set in advance.

In charging areas Q1*y*, Q1*m*, Q1*c* and Q1*k* where the photoreceptors Py to Pk and the charging rollers CRy to CRk face each other respectively, the charging rollers CRy to CRk charge the surfaces of the photoreceptors Py to Pk respectively. In latent image forming areas Q2*y*, Q2*m*, Q2*c* and Q2*k* on the downstream side of the charging areas Q1*y* to Q1*k* in the rotation directions of the photoreceptors Py to Pk, the latent image forming unit ROS writes latent images on the surfaces of the photoreceptors Py to Pk respectively. In developing areas Q3*y*, Q3*m*, Q3*c* and Q3*k* where the photoreceptors Py to Pk and the developing units Gy to Gk face each other respectively, electrostatic latent images of the photoreceptors Py to Pk are developed into toner images as an example of visible images. Thus, the image forming units UY to UK form the toner images of yellow, magenta, cyan and black as an example of visible images respectively.

When developers are consumed with the formation of the toner images, developers are supplied from the toner cartridges Ty to Tk to the developing units Gy to Gk through developer supply units Hy, Hm, Hc and Hk respectively.

The primary transfer rollers T1*y*, T1*m*, T1*c* and T1*k* transfer the toner images of the photoreceptors Py to Pk onto the intermediate transfer belt B in primary transfer areas Q4*y*, Q4*m*, Q4*c* and Q4*k* respectively.

The photoreceptor cleaners CLy, CLm, CLc and CLk clean residues or deposits such as transfer residual toners, discharge products, etc. adhering to the surfaces of the photoreceptors Py, Pm, Pc and Pk after the primary transfer respectively. The cleaned surfaces of the photoreceptors Py, Pm, Pc and Pk are charged again in the charging areas Q1*y* to Q1*k*.

A single-color or multi-color toner image transferred thus onto the intermediate transfer belt B in the primary transfer areas Q4*y*, Q4*m*, Q4*c* and Q4*k* is conveyed to a secondary transfer area Q5.

The conveyance roll Ra of the manual feed tray TR0 sends out a recording sheet S loaded on the tray body TR0*a* when paper is fed from the manual feed tray TR0.

When paper is fed from the paper feed tray TR1, the paper feed roll Rp sends out a recording sheet S loaded on the paper feed tray TR1. The recording sheet S sent out thus is sent to the registration roll Rr.

The registration roll Rr sends out the recording sheet S toward the secondary transfer area Q5 in accordance with the timing when the toner image on the intermediate transfer belt B arrives at the secondary transfer area Q5.

In the secondary transfer area Q5, the toner image on the surface of the intermediate transfer belt B is transferred onto the recording sheet S by a secondary transfer voltage applied to the secondary transfer unit T2.

From the intermediate transfer belt B from which the toner image has been transferred in the secondary transfer area Q5, residues such as transfer residual toners, discharge products, etc. are cleaned and removed by a not-shown belt cleaner.

The recording sheet S to which the toner image has been transferred is conveyed to a fixing area Q6 of the fixing unit F. In the fixing unit F, the unfixed toner image passing through the fixing area Q6 is fixed onto the recording sheet S by heat and pressure.

The recording sheet S on which the image has been fixed is discharged to the discharge tray TRh through the discharge roller Rh.

When both-side printing is performed, the discharge roller Rh rotates reversely as soon as a rear end of the recording sheet S where an image has been recorded on its first surface passes a branch position to the inversion path SH2. Thus, the recording sheet S is sent to the inversion path SH2. Then the recording sheet S conveyed in the inversion path SH2 is sent again to the registration roll Rr in the state where the recording sheet S has been inverted back to front.

(Manual Feed Tray)

Figure 3:
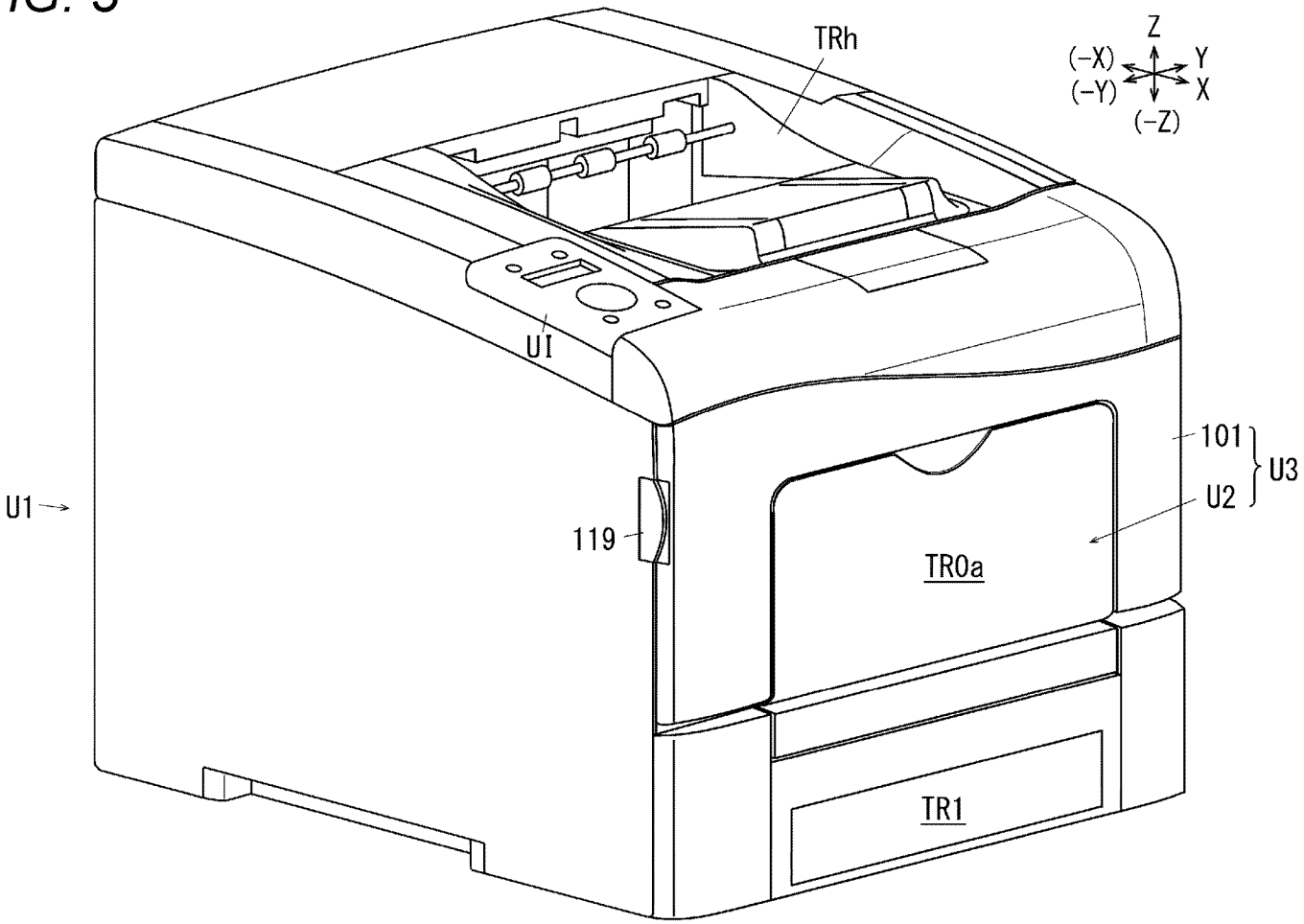
FIG. 3 is a perspective view of the printer according to Example 1.

FIG. 3 is a perspective view of the printer in Example 1.

Figure 4:
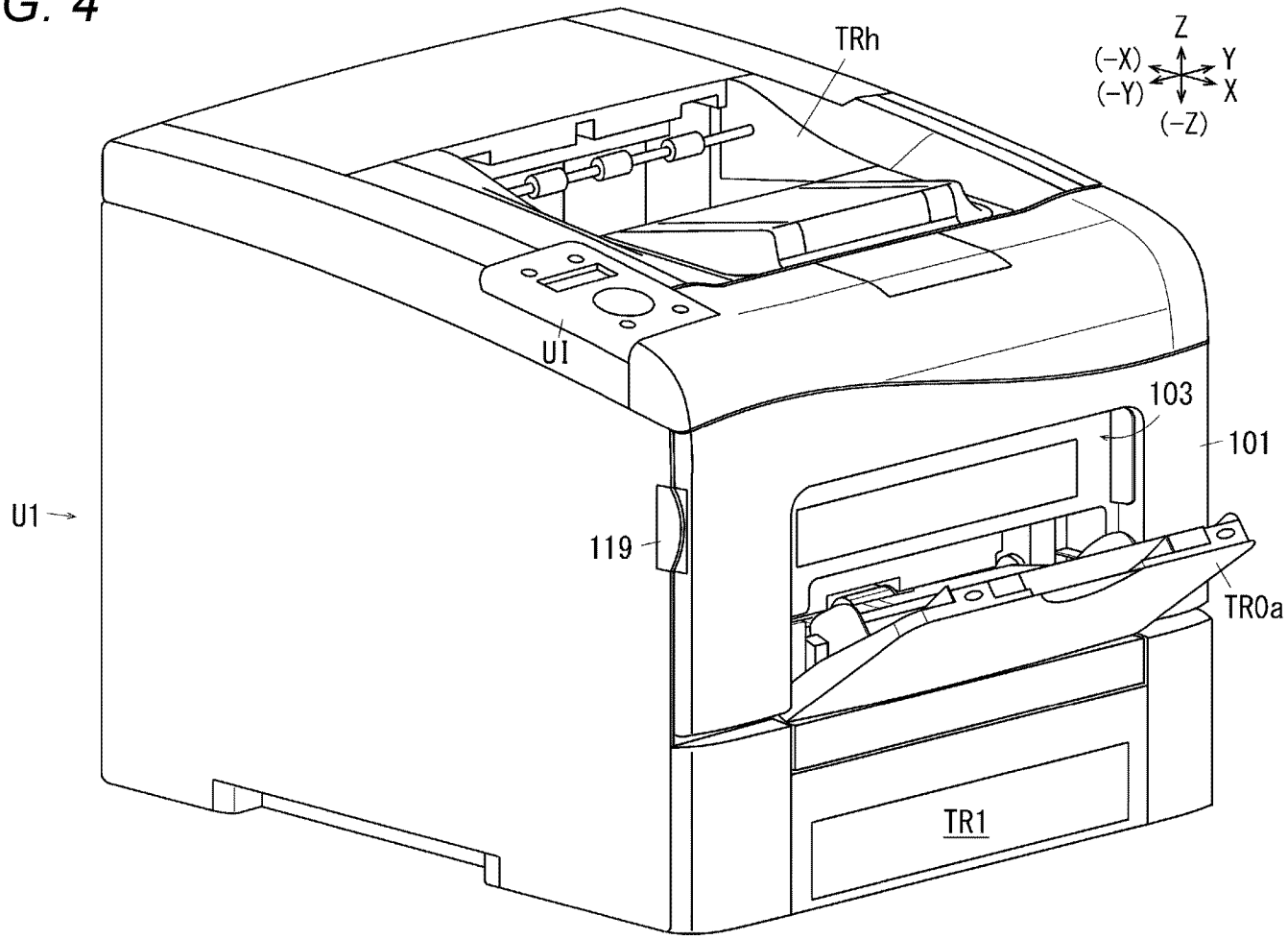
FIG. 4 is an explanatory view showing a case where a manual feed tray has been moved to a manual feed position in the printer shown in FIG. 3.

FIG. 4 is an explanatory view showing a case where the manual feed tray has been moved to a manual feed position in the printer shown in FIG. 3.

Figure 5:
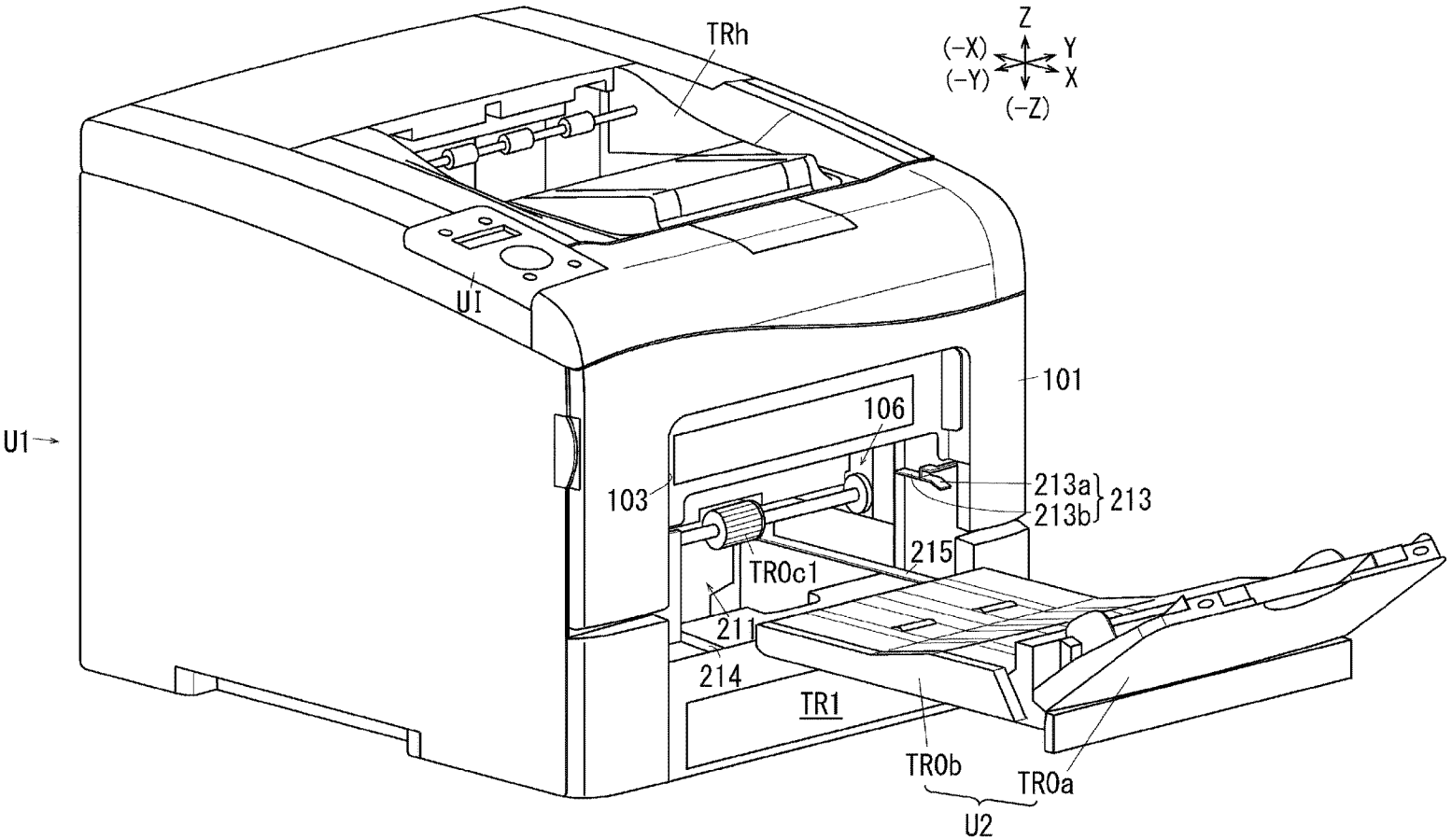
FIG. 5 is an explanatory view showing a case where a manual feed unit is removed from the printer shown in FIG. 3.

FIG. 5 is an explanatory view showing a case where the manual feed unit is removed from the printer shown in FIG. 3.

Figure 6:
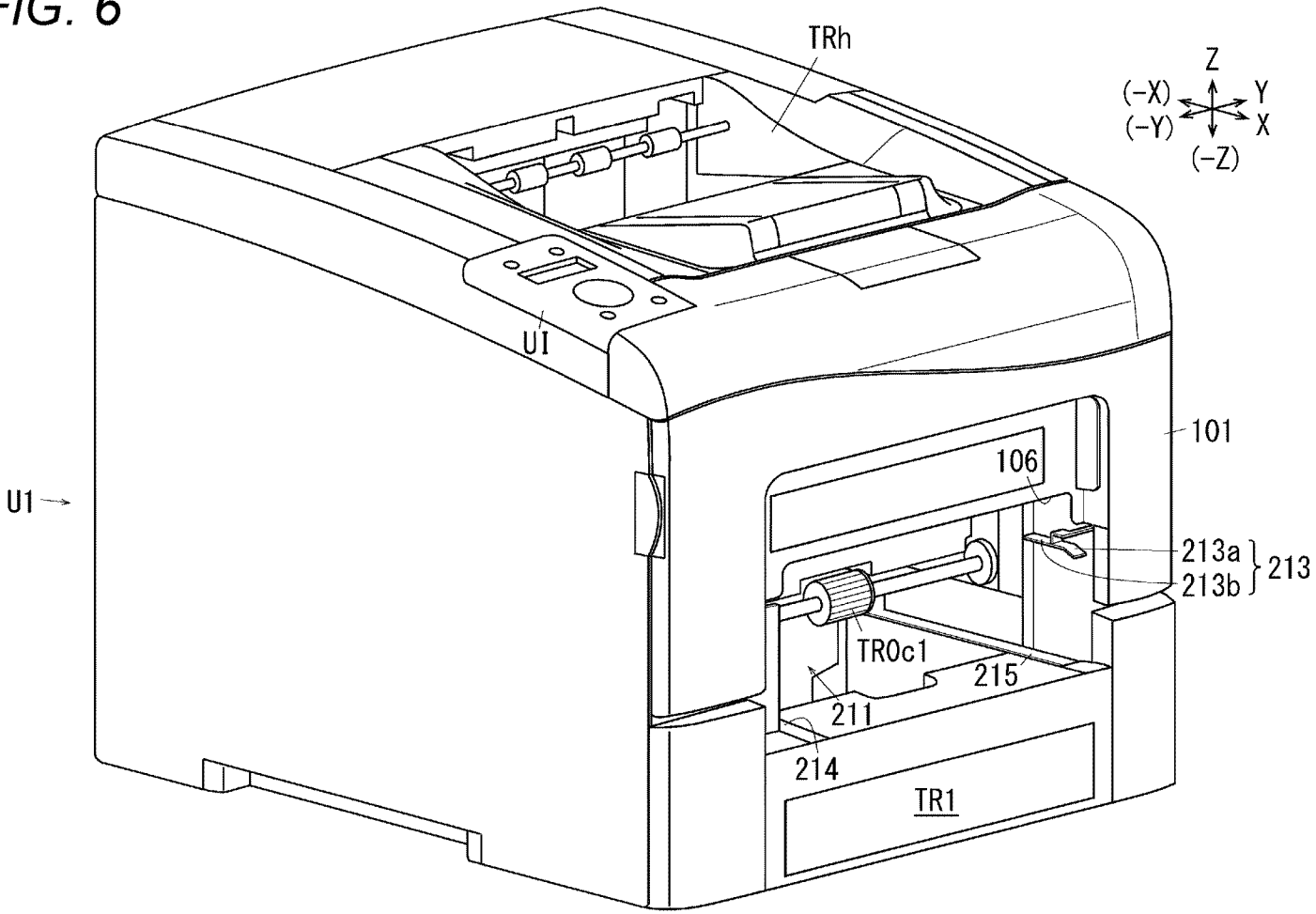
FIG. 6 is an explanatory view showing a case where the manual feed unit has been removed from the printer shown in FIG. 3.

FIG. 6 is an explanatory view showing a case where the manual feed unit has been removed from the printer shown in FIG. 3.

Figure 7:
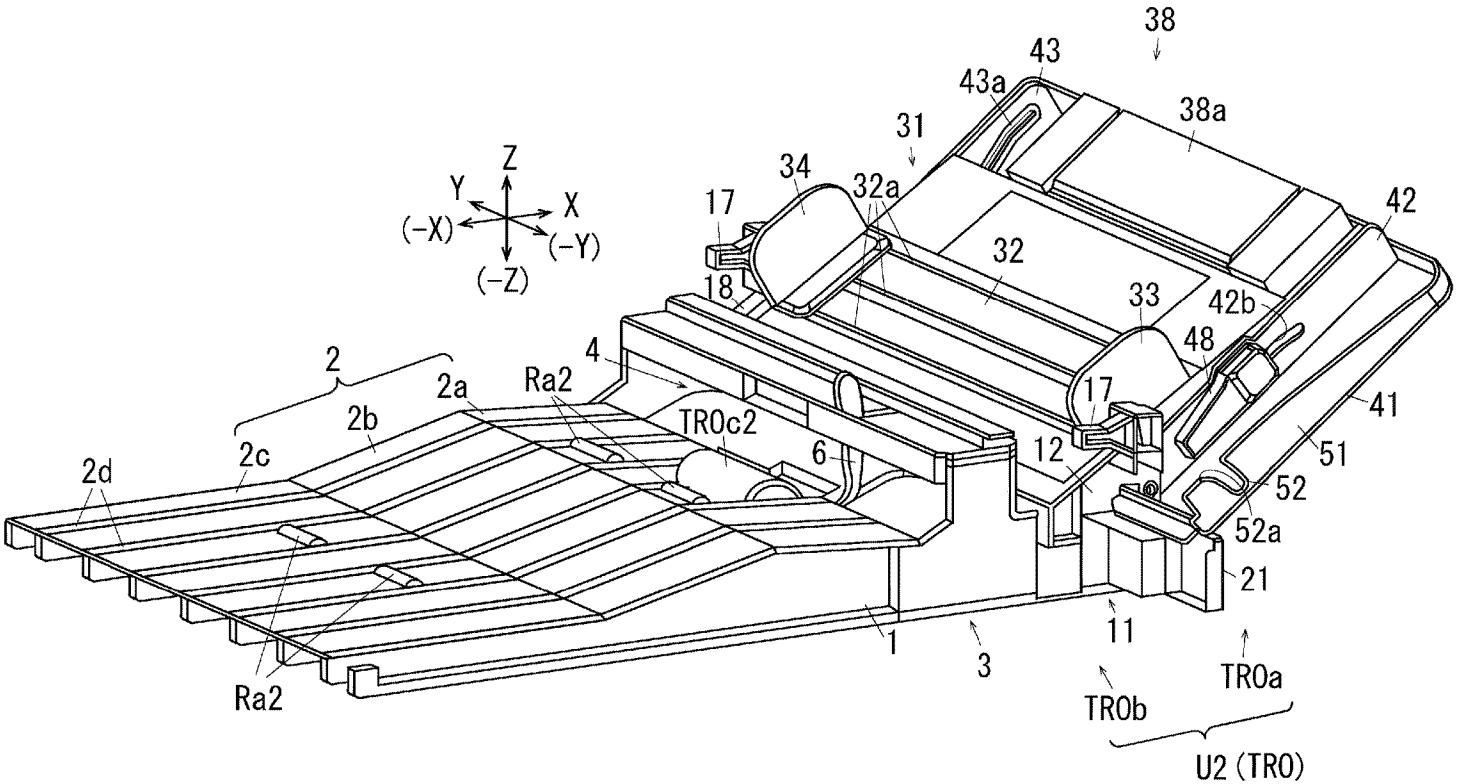
FIG. 7 is a perspective view of the manual feed unit in Example 1, which is an explanatory view showing a case where a tray body has been moved to the manual feed position.

FIG. 7 is a perspective view of the manual feed unit in Example 1, which is an explanatory view showing a case where the tray body has been moved to the manual feed position.

In FIG. 3 to FIG. 7, in the printer U according to Example 1, the manual feed tray TR0 as an example of a loading member is constituted by a manual feed unit U2, which can be removably attached to the printer U.

In FIG. 7, the manual feed unit U2 as an example of a second removable body in Example 1 includes a conveyance portion TR0*b* as an example of a base portion, which is supported on the apparatus body U1. The conveyance portion TR0*b* has a base portion 1 extending in the front/rear direction. A conveyance surface 2 as an example of a guide portion by which the recording sheet S is guided is formed above a rear portion of the base portion 1. The recording sheet 2 is conveyed on the conveyance surface 2. The conveyance surface 2 has a front portion 2*a*, an inclined portion 2*b* and a rear portion 2*c*. The front portion 2*a* extends rearward. The inclined portion 2*b* is formed at the rear of the front portion 2*a* and inclined downward as it goes rearward. The rear portion 2*c* is formed at the rear of the inclined portion 2*b* and extends rearward. A plurality of ribs 2*d* extending in the front/rear direction as an example of protruding lines are formed in the conveyance surface 2 and at intervals in the left/right direction, that is, in the sheet width direction. Here, in the front portion 2*a*, a driven-side separation roll TR0*c*2 is supported rotatably in accordance with a feed roll TR0*c*1 of the apparatus body U1. In addition, in the front portion 2*a*, a lower conveyance roll Ra2 is supported rotatably in accordance with an upper conveyance roll Ra1 of the apparatus body U1. Further, in the rear portion 2*c*, a lower conveyance roll Ra2 is supported rotatably in accordance with an upper conveyance roll Ra1 of the apparatus body U1.

A sheet detection portion 3 as an example of a medium detection portion is formed in front of the conveyance surface 2. A sheet passing port 4 the recording sheet 3 can pass is formed in the sheet detection portion 3. A contact arm 6 as an example of a medium contact member is supported rotatably in a central portion of the sheet passing port 4 in the sheet width direction. The contact arm 6 extends in the up/down direction. The contact arm 6 rotates in contact with the recording sheet S entering the sheet passing port 4. Incidentally, a not-shown electrical detection member for detecting the recording sheet S passing an upper end of the contact arm 6 is disposed above the contact arm 6 in order to detect whether the contact arm 6 contacts with the recording sheet S or not.

Figure 8:
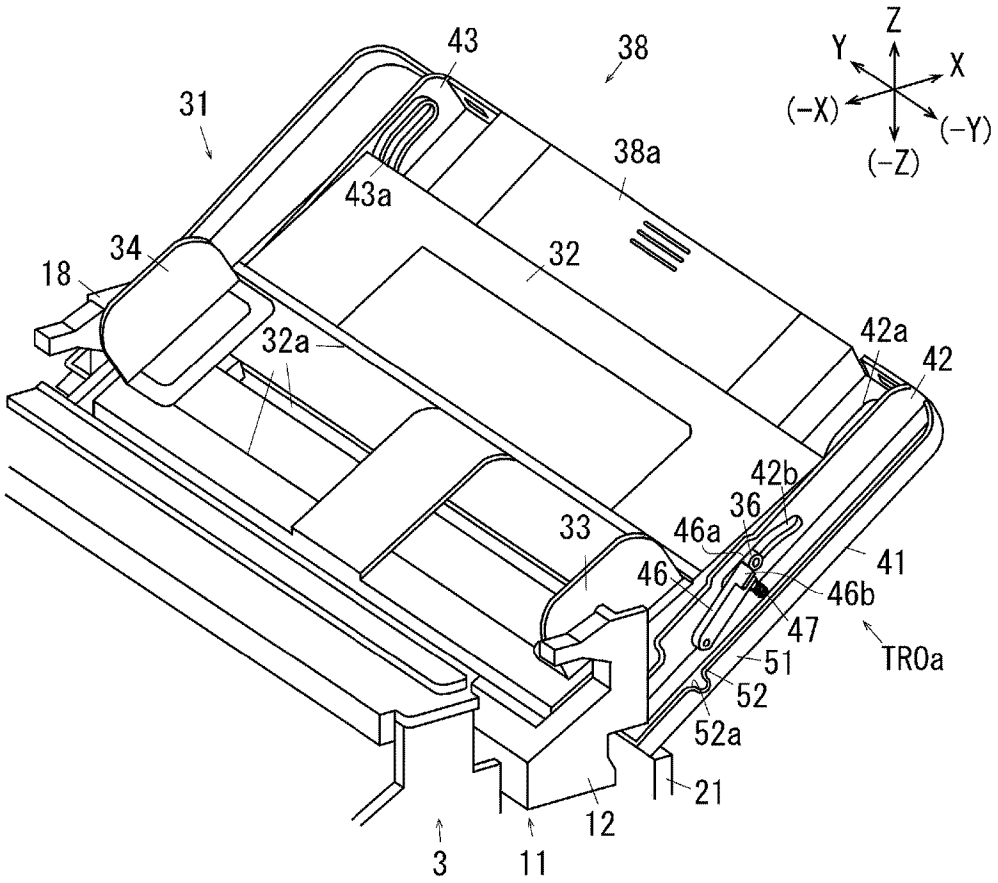
FIG. 8 is a main portion enlarged view of FIG. 7, which is an explanatory view where illustration of a latch cover is omitted.

FIG. 8 is a main portion enlarged view of FIG. 7, which is an explanatory view where illustration of a latch cover is omitted.

Figure 9:
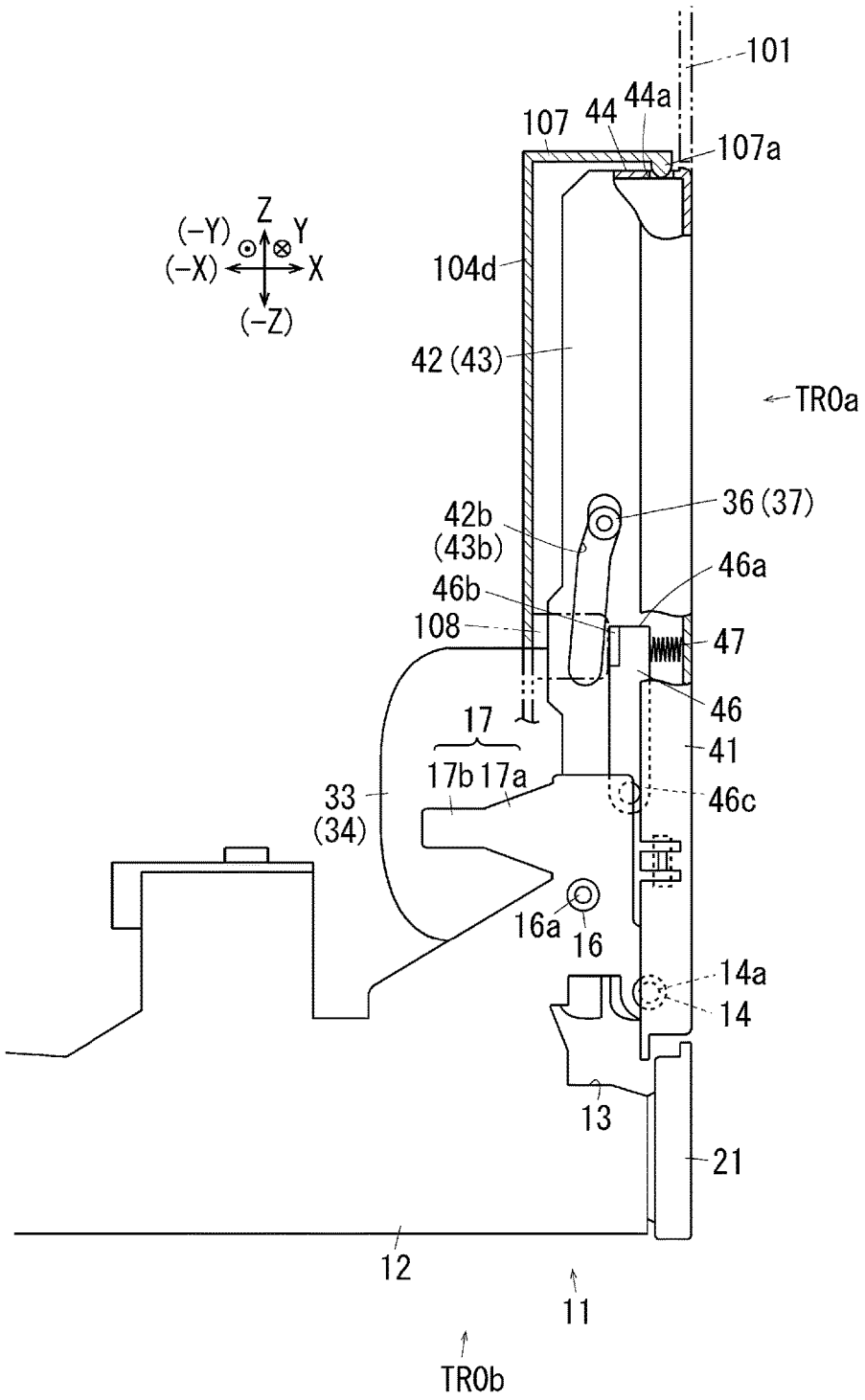
FIG. 9 is an explanatory view of a latch mechanism of the manual feed tray in Example 1, which is an explanatory view showing a case where the manual feed tray is in the position shown in FIG. 3.

FIG. 9 is an explanatory view of a latch mechanism of the manual feed tray in Example 1, which is an explanatory view showing a case where the manual feed tray is in the position shown in FIG. 3.

Figure 10:
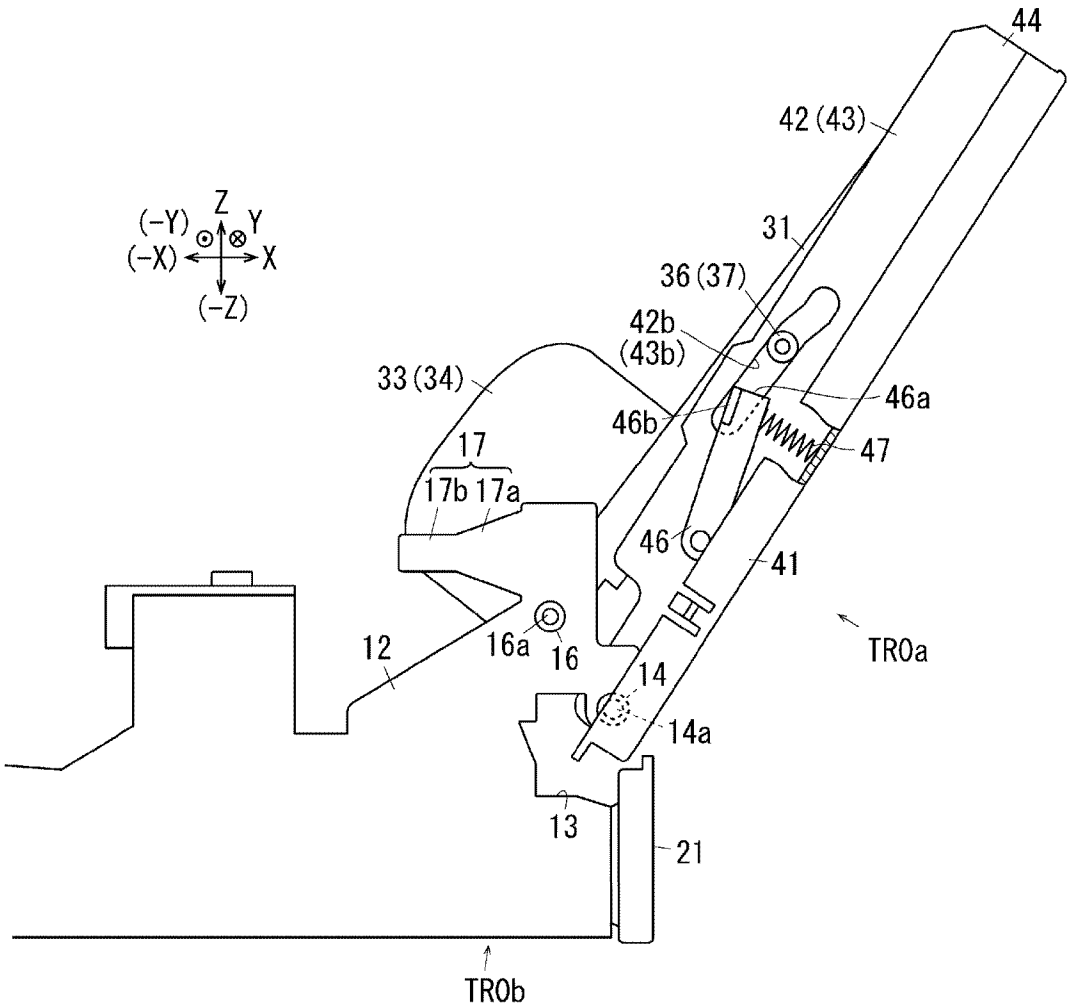
FIG. 10 is an explanatory view of the latch mechanism of the manual feed tray in Example 1, which is an explanatory view showing a case where the manual feed tray is moving between the position shown in FIG. 3 and the position shown in FIG. 4.

FIG. 10 is an explanatory view of the latch mechanism of the manual feed tray in Example 1, which is an explanatory view showing a case where the manual feed tray is moving between the position shown in FIG. 3 and the position shown in FIG. 4.

Figure 11:
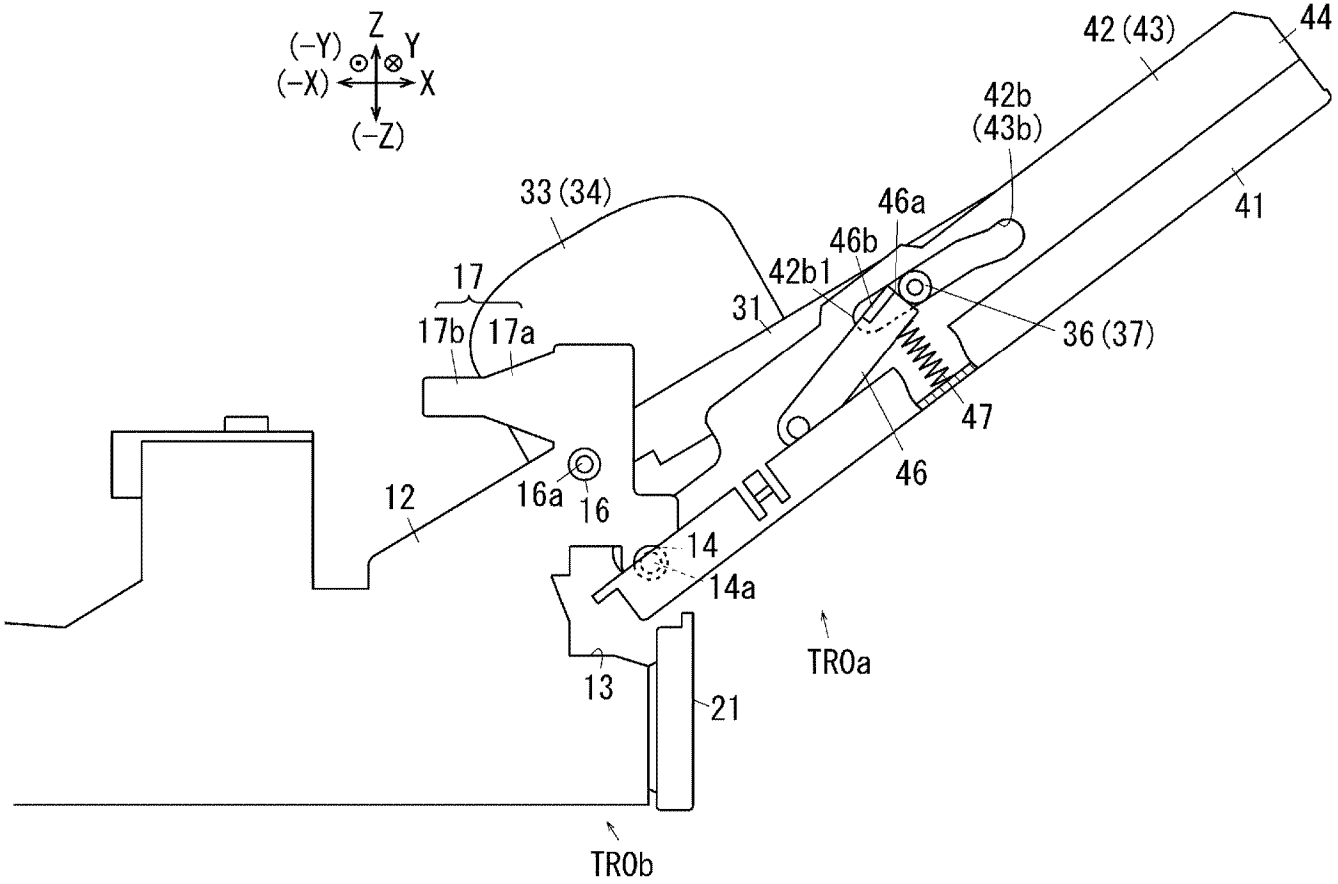
FIG. 11 is an explanatory view of the latch mechanism of the manual feed tray in Example 1, which is an explanatory view showing a case where the manual feed tray is in the position shown in FIG. 4.

FIG. 11 is an explanatory view of the latch mechanism of the manual feed tray in Example 1, which is an explanatory view showing a case where the manual feed tray is in the position shown in FIG. 4.

In FIG. 7, a manual feed coupling portion 11 is formed in front of the sheet detection portion 3. The manual feed coupling portion 11 includes a left side wall portion 12 formed in a left end portion thereof. The left side wall portion 12 is formed into a plate-like shape extending upward.

In FIG. 8 to FIG. 11, a notch portion 13 extending rearward and having a rear end going upward is formed in a front portion of the left side wall portion 12. In the left side wall portion 12, a cover support portion 14 is formed above the notch portion 13 and correspondingly thereto. A rotation shaft 14*a* extending in the left/right direction is supported rotatably on the cover support portion 14. A tray support portion 16 is also formed behind and above the cover support portion 14. A rotation shaft 16*a* extending in the left/right direction is supported rotatably on the tray support portion 16. Thus, the rotation center of the rotation shaft 14*a* is deviated from that of the rotation shaft 16*a*. A positioned portion 17 protruding rearward is formed above the tray support portion 16. The positioned portion 17 includes a pedestal portion 17*a* and a protruding portion 17*b*. The pedestal portion 17*a* has a trapezoidal shape, which is smaller in width in the up/down direction as it goes rearward. The protruding portion 17*b* has a rectangular parallelepiped shape, which is supported at the rear end of the pedestal portion 17*a* so as to protrude rearward. The left side wall portion 12 in Example 1 is constituted by the parts designated by the reference numerals 13 to 17.

In FIG. 7, the manual feed coupling portion 11 includes a right side wall portion 18 formed on the right side thereof. The right side wall portion 18 is formed in the same manner as the left side wall portion 12, except that the right side wall portion 18 is arranged symmetrically with the left side wall portion 12. Therefore, detailed description about the right side wall portion 18 will be omitted.

A lower panel 21 having a plate-like shape extending in the left/right direction is supported on a lower front portion of the manual feed coupling portion 11. The lower panel 21 is formed to be wider than the left/right-direction width of the base portion 1 in the manual feed coupling portion 11.

In FIG. 7 to FIG. 11, the tray body TR0*a* as an example of a second opening/closing member and as an example of a loading portion is supported on the side wall portions 12 and 18. The tray body TR0*a* includes a tray portion 31 as an example of a loading portion body. In FIG. 9 to FIG. 11, the tray portion 31 is supported on the tray support portions 16 in the left and right side wall portions 12 and 18 so that the tray portion 31 can rotate through the rotation shaft 16*a*. A loading surface 32 where the recording sheet S is loaded is formed in the tray portion 31. A guide groove 32*a* as an example of a guide groove extending in the sheet width direction is formed in the loading surface 32. In the loading surface 32, a pair of sheet guides 33 and 34 are formed in the sheet width direction. The sheet guides 33 and 34 are supported movably along the guide groove 32*a*. Stopper shafts 36 and 37 as an example of stopper shaft portions protruding outward in the left/right direction are supported on the left and right side wall portions of the tray portion 31 respectively.

In FIG. 7 and FIG. 8, the tray body TR0*a* in Example 1 has an extension tray portion 38 as an example of an extension loading portion. The extension tray portion 38 is disposed above the tray portion 31. The extension tray portion 38 includes an extension loading surface 38*a*, which is supported to be able to be taken in/out in the direction in which the loading surface 32 is extended. Not-shown protruding portions protruding outward in the left/right direction are supported on the left and right side portions of the extension tray portion 38.

The tray body TR0*a* in Example 1 includes a tray cover 41 as an example of an exterior member of the loading portion. The tray cover 41 is formed into a plate-like shape. The tray cover 41 is supported on the cover support portions 14 in the left and right side wall portions 12 and 18 rotatably through the rotation shaft 14*a*. Reception walls 42 and 43 like erect walls extending in the up/down direction are supported on the left and right of the tray cover 41. In FIG. 8, upper guide grooves 42*a* and 43*a* are formed in the left/right-direction inner surfaces of the reception walls 42 and 43. In FIG. 9, guide holes 42*b* and 43*b* penetrating the reception walls 42 and 43 in the thickness direction are formed under the guide grooves 42*a* and 43*a* respectively. Each guide hole 42*b*, 43*b* is formed into a long hole extending in a direction to leave the rotation shaft 16*a* of the tray support portion 16.

A top wall 44 having a wall-like shape extending in the left/right direction is supported on the upper portions of the reception walls 42 and 43. In FIG. 9, retention recess portions 44*a* recessed downward are formed in the top wall 44. The retention recess portions 44*a* are paired on the left and right. In FIG. 7 to FIG. 9, the tray portion 31 and the extension tray portion 38 are received in a space surrounded by the reception walls 42 and 43 and the top wall 44. Here, the not-shown protruding portions of the extension tray portion 38 are supported in the upper guide grooves 42*a* and 43*a* so that the protruding portions can be guided thereby. On the other hand, the stopper shafts 36 and 37 of the tray portion 31 are inserted into the lower guide holes 42*b* and 43*b*. The stopper shafts 36 and 37, which have protruded outward in the left/right direction from the reception walls 42 and 43, are supported in the guide holes so that the stopper shafts 36 and 37 can be guided thereby.

A latch arm 46 as an example of an engagement member is disposed on the left side of the left reception wall 42 correspondingly to a position deviated from the guide hole 42*b* toward the rotation shaft 14*a*. In FIG. 9, the latch arm 46 is formed into a columnar shape extending in the up/down direction. A shaft restriction portion 46*a* is formed in the upper end surface of the latch arm 46. A projecting portion 46*b* having a plate-like shape projecting to the left is supported on an upper portion of the left side surface of the latch arm 46. A lower end 46*c* of the latch arm 46 is supported on the reception wall 42 so that the latch arm 46 can rotate around a rotation axis extending in the left/right direction. A pushing spring 47 as an example of an urging member is disposed between the upper end of the latch arm 46 and the tray cover 41. The pushing spring 47 urges the upper end of the latch arm 46 in a direction to leave the tray cover 41. In FIG. 7, the latch arm 46 and the pushing spring 47 are covered with a latch cover 48 as an example of a protection member.

In FIG. 7, a pair of left and right outer wall portions 51 are supported on the opposite left and right ends of the tray cover 41. In the left outer wall portion 51, a support slit 52 as an example of a support portion is formed in a rear lower portion located on the rotation shaft 14*a* side. The support slit 52 is formed into an arc shape around the rotation shaft 14*a* of the cover support portion 14. The support slit 52 in Example 1 is formed into a groove-like shape extending from the inner edge of the outer wall portion 51 toward the outside. That is, a detachment portion 52*a* having an opening shape is formed at the inner end of the support slit 51 in Example 1.

Thus, in the tray body TR0*a* in Example 1, the tray portion 31 is supported rotatably on the tray support portion 16, and the tray cover 41 is supported rotatably on the cover support portion 14. That is, the tray body TR0*a* is supported movably around the rotation shafts 16*a* and 14*a* relatively to the conveyance portion TR0*b*.

(Front Cover)

Figure 12:
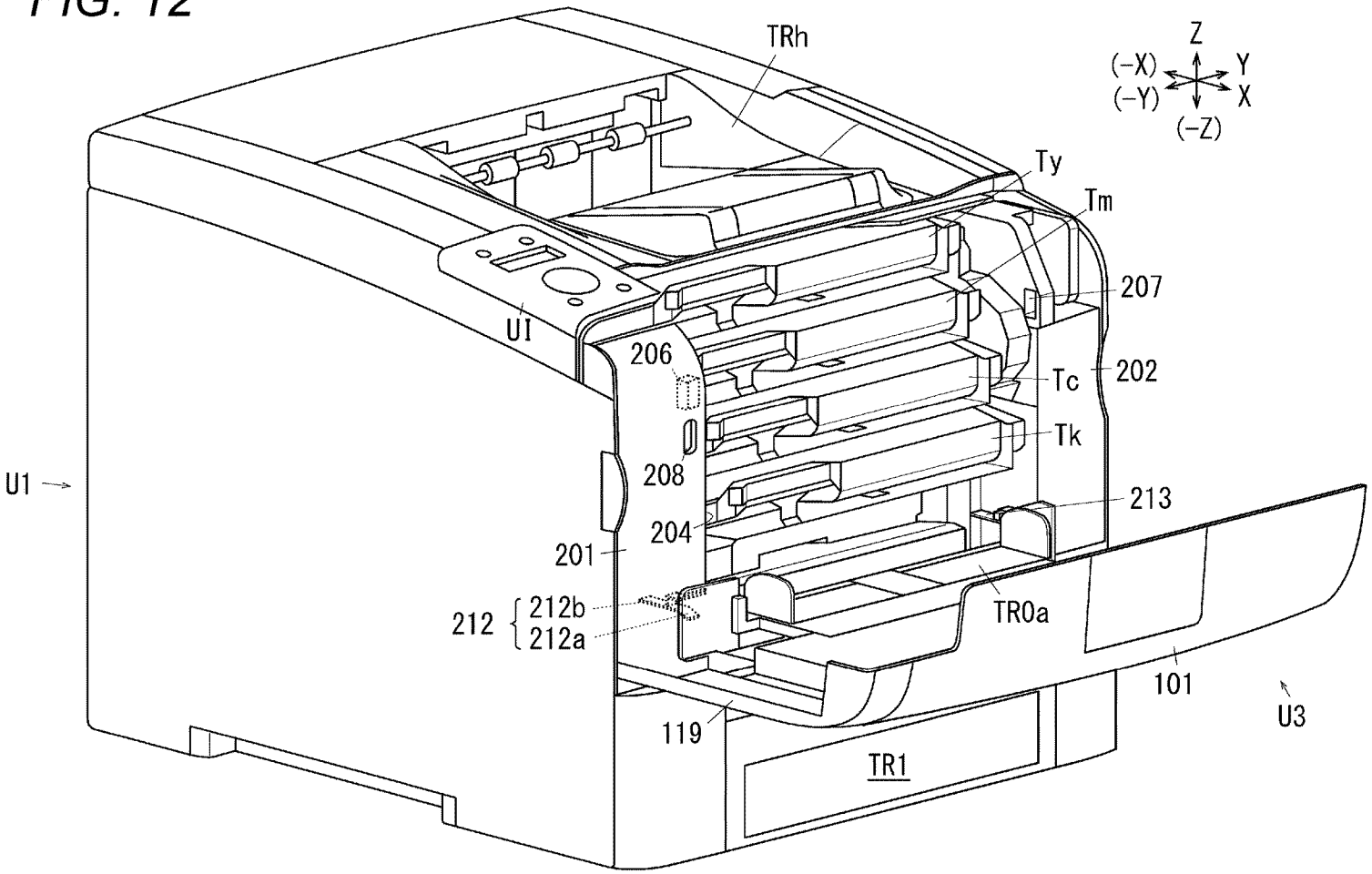
FIG. 12 is an explanatory view showing a case where a front cover has been moved to a working position in the printer shown in FIG. 3.

FIG. 12 is an explanatory view showing a case where a front cover has been moved to a working position in the printer shown in FIG. 3.

Figure 13:
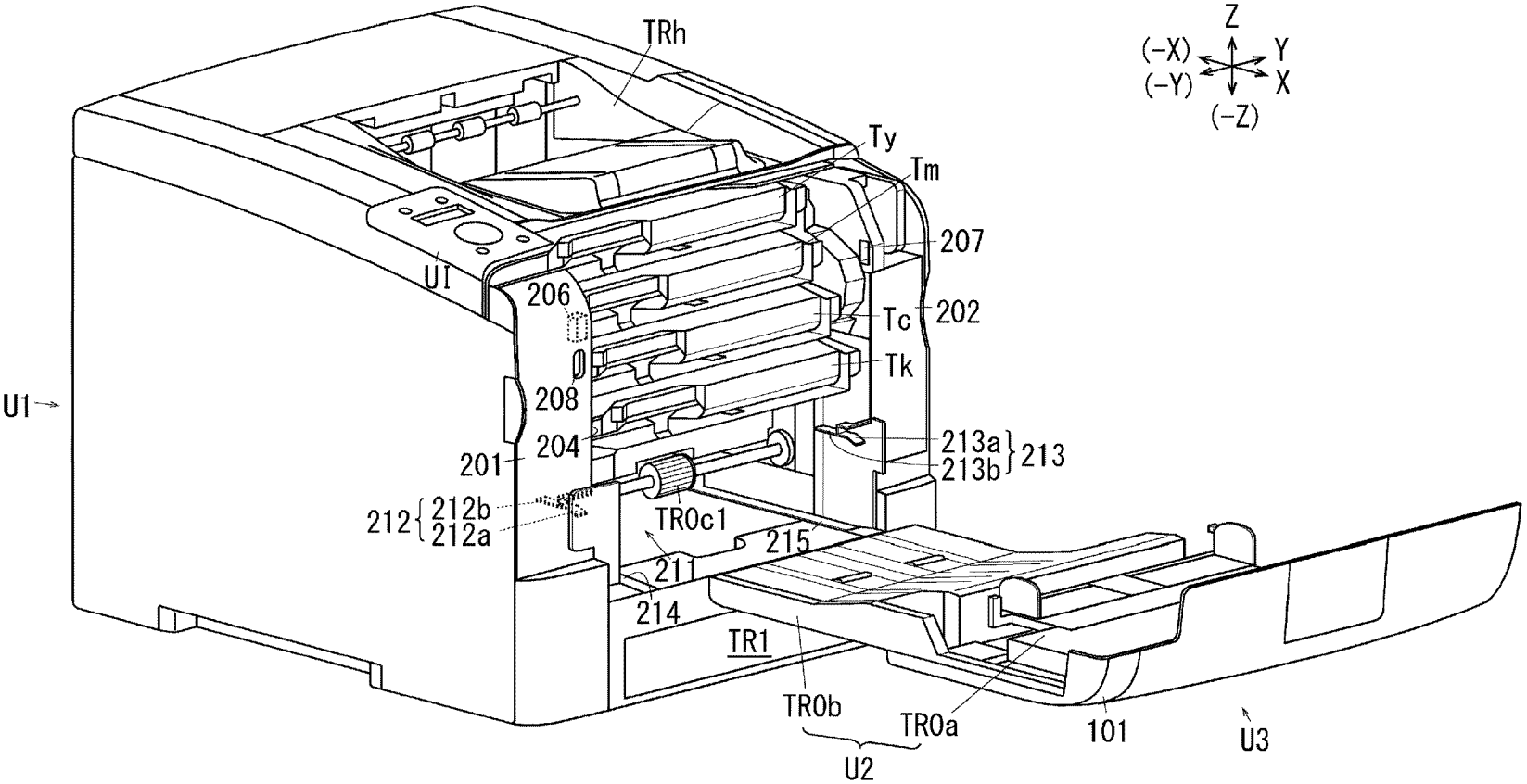
FIG. 13 is an explanatory view showing a case where a removable unit is attached to or removed from the printer shown in FIG. 3.

FIG. 13 is an explanatory view showing a case where a removable unit is attached to or removed from the printer shown in FIG. 3.

Figure 14:
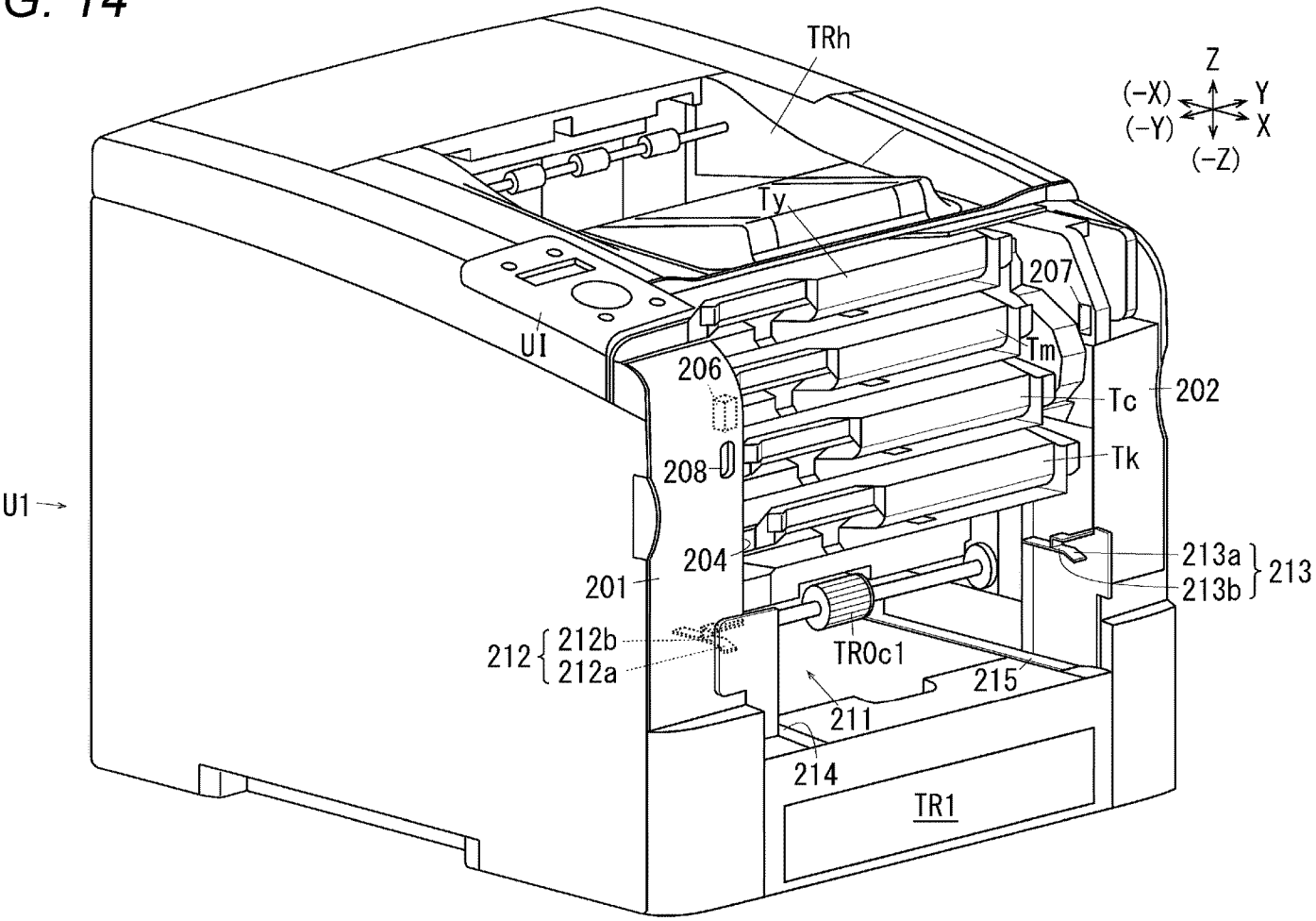
FIG. 14 is an explanatory view showing a case where the removable unit has been removed from the printer shown in FIG. 3.

FIG. 14 is an explanatory view showing a case where the removable unit has been removed from the printer shown in FIG. 3.

Figure 15:
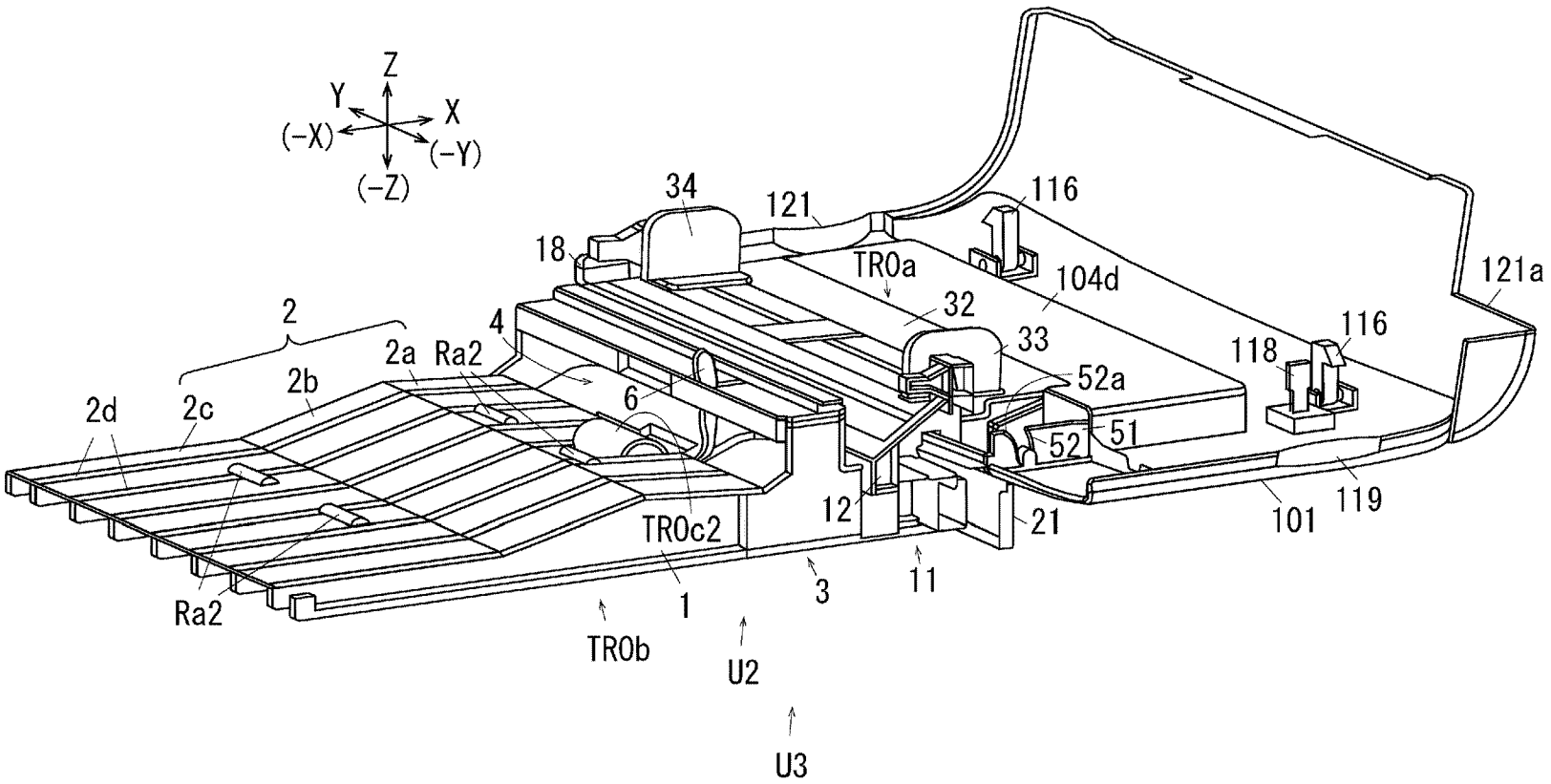
FIG. 15 is a perspective view of the removable unit in Example 1, which is an explanatory view showing a case where the front cover has been moved to the working position.

FIG. 15 is a perspective view of the removable unit in Example 1, which is an explanatory view showing a case where the front cover has been moved to the working position.

Figure 16:
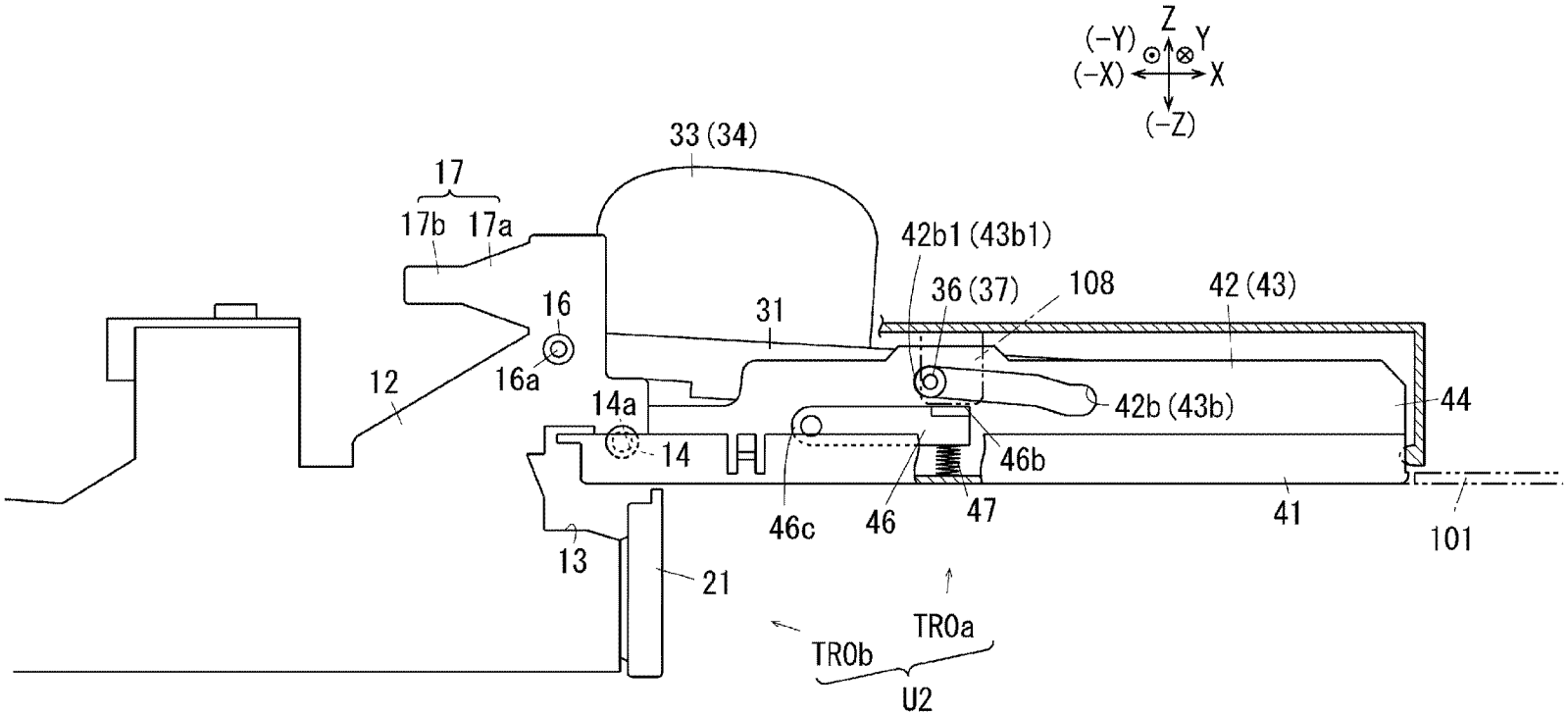
FIG. 16 is an explanatory view of the latch mechanism in Example 1, which is an explanatory view showing a case where the manual feed tray is in the position shown in FIG. 15.

FIG. 16 is an explanatory view of a latch mechanism in Example 1, which is an explanatory view showing a case where the manual feed tray is in the position shown in FIG. 15.

In FIG. 12 to FIG. 16, in the printer U according to Example 1, a removable unit U3 as an example of a first removable body is arranged to be removably attached to the printer U. The removable unit U3 in Example 1 includes the manual feed unit U2 and a front cover 101 as an example of a first opening/closing member. The front cover 101 is supported on the manual feed unit U2.

FIG. 17 is a perspective view of the removable unit in Example 1, which is an explanatory view showing a case where the front cover has been moved to a closing position.

Figure 18:
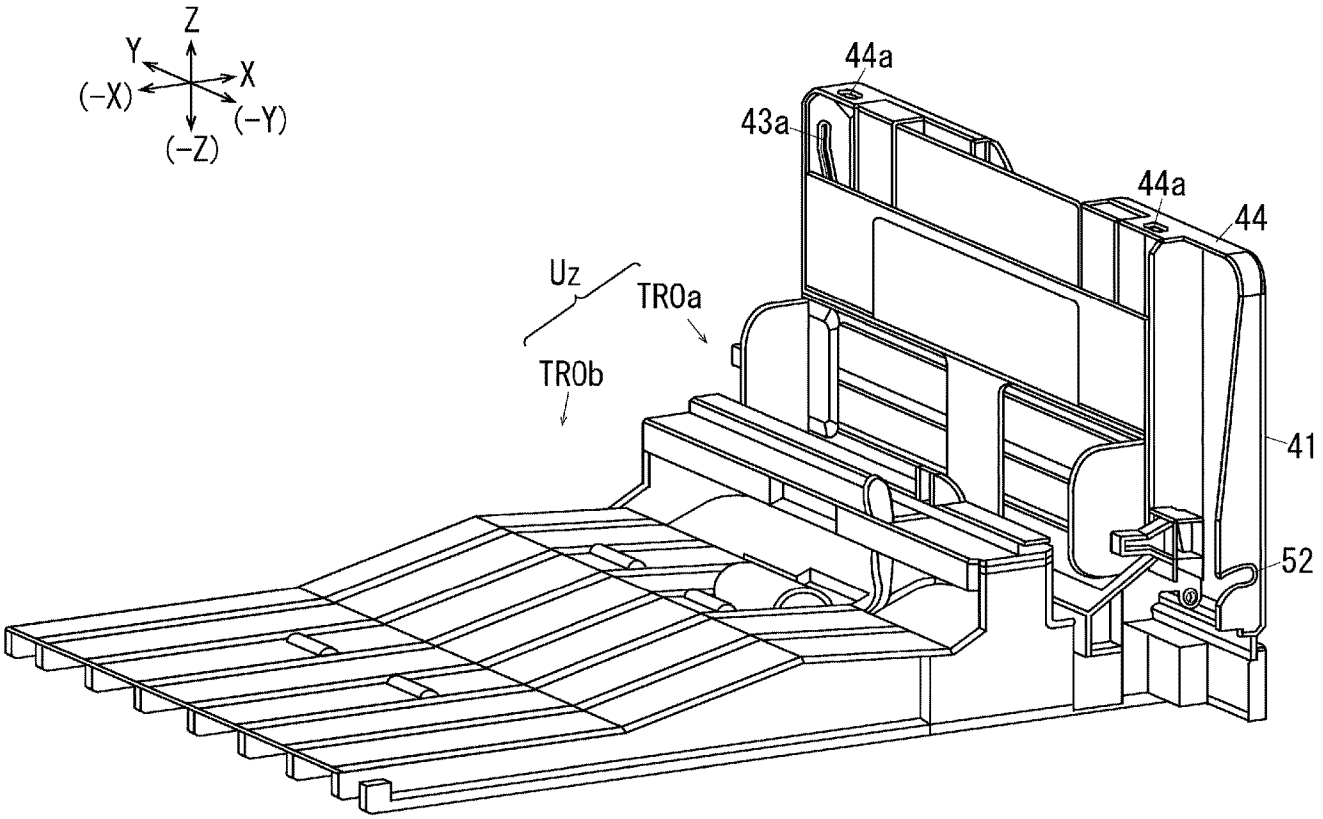
FIG. 18 is an explanatory view showing a case where illustration of the front cover is omitted from FIG. 17.

FIG. 18 is an explanatory view showing a case where illustration of the front cover is omitted from FIG. 17.

Figure 19:
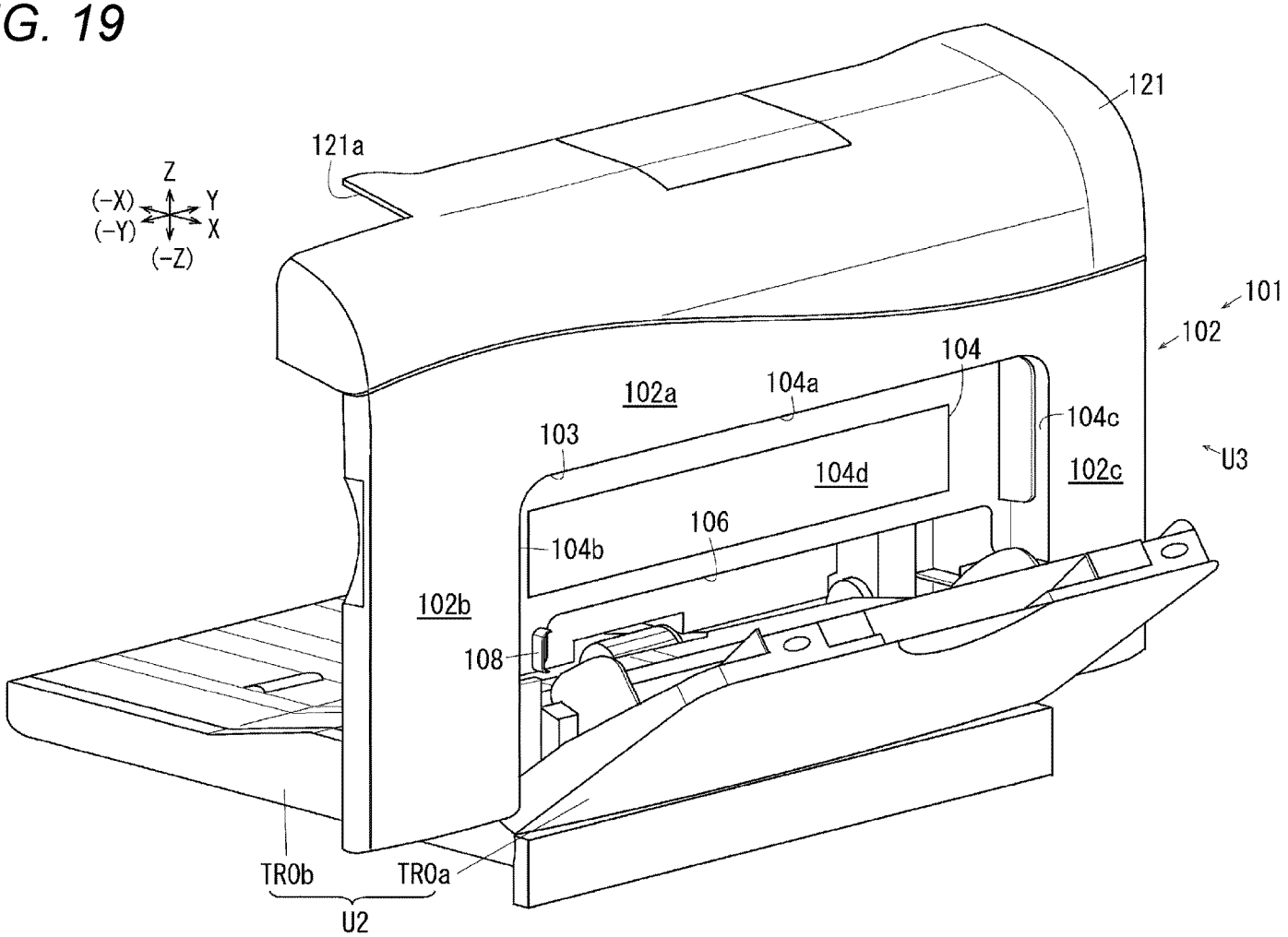
FIG. 19 is an explanatory view showing a case where the manual feed tray has been moved to the manual feed position in the removable unit shown in FIG. 17.

FIG. 19 is an explanatory view showing a case where the manual feed tray has been moved to a manual feed position in the removable unit shown in FIG. 17.

FIG. 20 is an explanatory view corresponding to FIG. 19 and showing a case where the removable unit is observed from the rear.

In FIG. 17 to FIG. 20, the front cover 101 includes a cover body portion 102, which can cover the front surface of the apparatus body U1. In FIG. 19, the cover body portion 102 is formed into a gate-like shape when it is observed from the front. That is, the cover body portion 102 has an upper portion 102*a*, and a pair of left and right side portions 102*b* and 102*c*. The upper portion 102*a* extends in the left/right direction. The side portions 102*b* and 102*c* extend downward from the left/right-direction opposite ends of the upper portion 102*a* respectively. A reception portion 103 as an example of an opening in Example 1 is formed by a shape surrounded by the upper portion 102*a* and the side portions 102*b* and 102*c*. The reception portion 103 is arranged correspondingly to the dimensions of the tray body TR0*a*.

A reception recess portion 104 closing an upper portion of the reception portion 103 is formed in the upper portion of the reception portion 103. The reception recess portion 104 is formed into a recess shape recessed from the front surface of the cover body portion 102. The reception recess portion 104 has an upper portion 104*a*, a left portion 104*b* and a right portion 104*c*. The upper portion 104*a* has a shape like a side wall extending rearward from the upper edge of the reception portion 103. The left portion 104*b* has a shape like a side wall extending rearward from an upper portion of the left edge of the reception portion 103. The right portion 104*c* has a shape like a side wall extending rearward from an upper portion of the right edge of the reception portion 103. An inner wall 104*d* having a plate-like shape is formed integrally with the rear ends of the respective portions 104*a* to 104*c*. An attachment/detachment port 106 is formed in a lower portion of the inner wall 104*d* so as to penetrate the inner wall 104*d* in the front/rear direction.

In FIG. 17, a retention arm 107 as an example of a retention portion for a second opening/closing member is formed in the upper portion 104*a* of the reception recess portion 104. In Example 1, a cutout having an inverted U-shape is formed to extend from the inner wall 104*d* to the upper portion 104*a*. Due to the part surrounded by the cutout, the retention arm 107 is formed to be able to be elastically deformed. That is, the retention arm 107 is formed into a shape like a plate spring whose inner end is supported in a cantilever manner. In FIG. 9, a protruding portion 107*a* protruding into the reception recess portion 104 is formed in a front end portion of the retention arm 107. Such retention arms 107 are formed to be paired on the left and right in accordance with the retention recess portions 44*a* of the tray body TR0*a*.

In FIG. 19, a latch releasing portion 108 having a plate-like shape protruding frontward as an example of a second engagement member is supported on a left portion of the inner wall 104*d* correspondingly to the left side of the attachment/detachment port 106. The latch releasing portion 108 is disposed correspondingly to the position of the projecting portion 46*b* of the latch arm 46 in the tray body TR0*a*.

In FIG. 17, a boss 111 as an example of a supported portion is supported on the left/right-direction outer side of the attachment/detachment port 106. The boss 111 has a base end portion 111*a* and a boss body portion 111*b*. The base end portion 111*a* is formed integrally with the cover body portion 102. The boss body portion 111*b* protrudes inward in the left/right direction from the base end portion 111*a*. The boss body portion 111*b* is formed in accordance with the support slit 52 of the tray body TR0*a*. The boss body portion 111*b* is formed to have a diameter corresponding to the groove width of the support slit 52.

In FIG. 17, a pair of left and right latch portions 116 as an example of hook portions are provided in an upper portion of the inner surface of the cover body portion 102. Each latch portion 116 is supported so that the latch portion 116 can rotate relatively to the cover body portion 102 and around a rotation shaft extending in the up/down direction from its front end portion. The latch portion 116 is formed into a columnar shape extending rearward from the rotation shaft. The rear end of the latch portion 116 is formed into a claw-like shape protruding outward in the left/right direction. The rear end of the latch portion 116 is urged outward in the left/right direction by a torsion spring 117 as an example of an urging member. Incidentally, the elastic force of the torsion spring 117 is set to be larger than the elastic force with which the retention arms 107 retain the tray body TR0*a*.

A switch pushing portion 118 as an example of an electric switch member is supported on the left lower side of the left latch portion 116. The switch pushing portion 118 is formed into a plate-like shape extending inward from the cover body portion 102.

A pair of left and right operation recess portions 119 and 120 are formed under the switch pushing portion 118. The operation recess portions 119 and 120 are recessed inward in the left/right direction so that an operator can hook his/her fingers around the operation recess portions 119 and 120 when he/she opens the front cover 101.

In FIG. 17 to FIG. 20, a cover top portion 121 extending rearward is supported on the upper end of the cover body portion 102. A notch portion 121*a* notched like a rectangular shape is formed in a left rear portion of the cover top portion 121 in accordance with the position of an operation portion UI of the apparatus body U1.

The front cover 101 in Example 1 is constituted by the cover body portion 102 and the cover top portion 121.

The removable unit U3 in Example 1 is constituted by the manual feed unit U2 and the front cover 101.

(Apparatus Body U1)

In FIG. 14, the apparatus body U1 of the printer U includes a left frame 201 and a right frame 202. The discharge tray TRh is supported on upper portions of the frames 201 and 202. The paper feed tray TR1 is removably supported on lower portions of the frames 201 and 202. An opening portion 204 is constituted by an opening shape formed by the left frame 201, the right frame 202, the discharge tray TRh and the paper feed tray TR1 so that the inside of the apparatus body U1 can be opened to the outside through the opening portion 204.

Above the opening portion 204 and correspondingly thereto, hook portions 206 and 207 recessed outward in the left/right direction are formed in the inner side surfaces of the frames 201 and 202. The hook portions 206 and 207 are formed so that the latch portions 116 and 116 of the front cover 101 can be hooked thereon. In the front surface of the left frame 201, a through hole 208 penetrating the left frame 201 in the front/rear direction is formed correspondingly to the position of the switch pushing portion 118 of the front cover 101. A not-shown interlock switch as an example of an electric switch is disposed inside the through hole 208. The interlock switch is disposed in a position where the interlock switch can be pushed when the switch pushing portion 118 is inserted into the through hole 208.

Correspondingly to the upper inside of the opening portion 204, the toner cartridges Ty to Tk as an example of replaceable components are removably supported between the left frame 201 and the right frame 202. The toner cartridges Ty, Tm, Tc and Tk are supported to form steps sequentially from the rear upper side to the front lower side. The toner cartridges Ty to Tk are designed to be able to be pulled out frontward. Under the toner cartridges Ty to Tk, of the feed rolls TR0*c*, a driving-side feed roll TR0*c*1 is supported.

Correspondingly to the lower side of the opening portion 204, a mounting portion 211 on which the conveyance portion TR0*b* of the manual feed unit U2 is mounted is constituted by a space surrounded by the left frame 201, the right frame 202, the feed roll TR0*c*1 and the paper feed tray TR1. In FIG. 5, the mounting portion 211 is formed correspondingly to the rear of the attachment/detachment port 106 of the front cover 101. In FIG. 14, a pair of left and right positioning portions 212 and 213 are formed in a front upper portion of the mounting portion 211. The positioning portions 212 and 213 are formed correspondingly to the positioned portions 17 and 17 of the manual feed unit U2. The positioning portions 212 and 213 in Example 1 are formed into a shape like an erect wall projecting inward from the inner side surfaces of the frames 201 and 202 so that the positioning portions 212 and 213 can guide the positioned portions 17 and 17. That is, in FIG. 14, each positioning portion 212, 213 in Example 1 includes a front portion 212*a*, 213*a*, and a rear portion 212*b*, 213*b*. The front portion 212*a*, 213*a* has a vertical distance longer as goes on the front side, so that the pedestal portion 17*a* can be received in the front portion 212*a*, 213*a*. The rear portion 212*b*, 213*b* is formed behind the front portion 212*a*, 213*a* so that the rear portion 212*b*, 213*b* can receive the protruding portion 17*b*. A pair of left and right guide portions 214 and 215 are formed in a lower portion of the mounting portion 211 so that the guide portions 214 can guide the conveyance portion TR rearward.

(Functions of Manual Feed Tray and Front Cover]

Figure 21A:
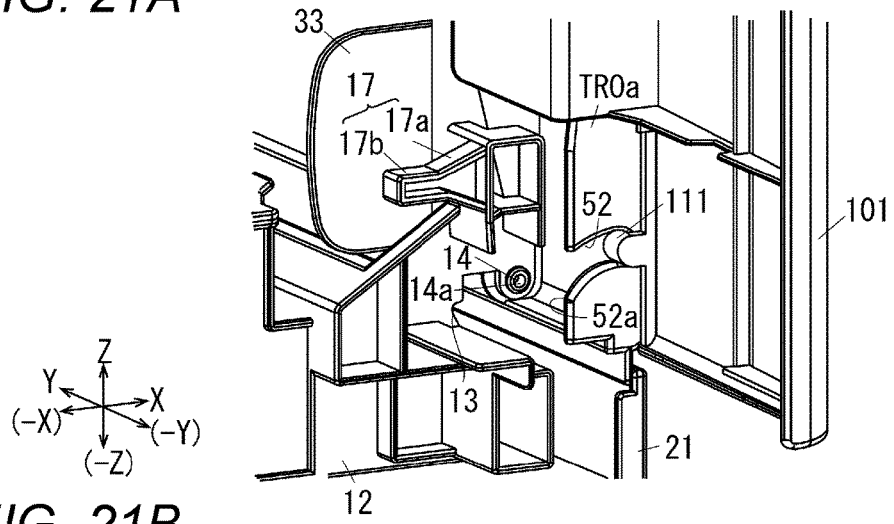
FIGS. 21A, 21B and 21C are views for explaining operations of the manual feed tray and the front cover.
Figure 21B:
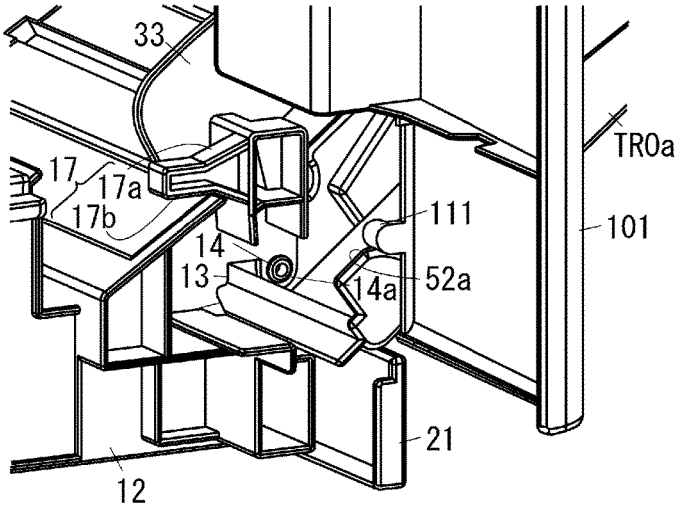
Figure 21C:
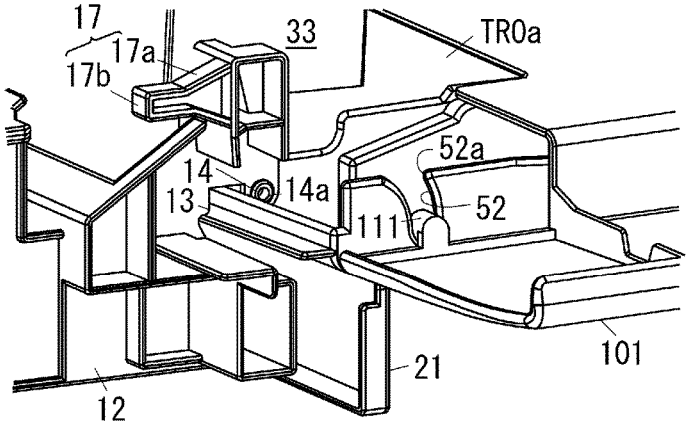

FIGS. 21A to 21C are views for explaining operations of the manual feed tray and the front cover in Example 1. FIG. 21A is an explanatory view showing a case where the manual feed tray and the front cover have been moved to the closing position. FIG. 21B is an explanatory view showing a case where the manual feed tray has been moved to the manual feed position. FIG. 21C is an explanatory view showing a case where the front cover has been moved to the working position.

In the printer U according to Example 1 configured thus, in the closing position shown in FIG. 3 as an example of a second closing position, the opening 204 opening the inside of the apparatus body U1 is closed by the front cover 101 and the manual feed unit U2. On this occasion, the front cover 101 is supported on the frames 201 and 202 of the apparatus body U1 in the state where the latch portions 116 and 116 have been hooked on the hook portions 206 and 207. In addition, the manual feed unit U2 is mounted on the mounting portion 211 inside the apparatus body U1 in the state where the conveyance portion TR0*b* has been inserted into the attachment/detachment port 106 of the front cover 101. Further, the tray body TR0*a* supported on the conveyance portion TR0*b* is received in the reception portion 103 of the front cover 101. In addition, as shown in FIG. 21A, the support slit 52 of the tray body TR0*a* is fitted and attached to the boss 111 of the front cover 101.

In FIG. 9, in the tray body TR0*a* received in the reception portion 103, the retention protrusions 107*a* and 107*a* of the retention arms 107 and 107 entering the retention recess portions 44*a* and 44*a* in the upper portion of the tray body TR0*a* are hooked therein. Thus, the tray body TR0*a* is retained in a manual feed closing position as an example of a second closing position in which the reception portion 103 formed in the front cover 101 is closed. On this occasion, the latch releasing portion 108 of the front cover 101 keeps the projecting portion 46*b* of the latch arm 46 in a state where the latch releasing portion 108 is pushing the projecting portion 46*b*. That is, in the manual feed closing position, the pushing spring 47 is kept in a state where the pushing spring 47 has been elastically compressed. The latch arm 46 is retained in a retracted position in which the shaft restriction portion 46*a* has been retracted from the guide hole 42*b* as shown in FIG. 9.

In FIG. 3 and FIG. 4, when the recording sheet S is fed manually, the operator opens the tray body TR0*a* frontward manually. On this occasion, the front cover 101 also tries to be opened frontward through the retention arms 107 and 107. However, the urging force of the retention arms 107 and 107 in Example 1 is set to be smaller than the urging force of the latch portions 116 and 116. Accordingly, when the tray body TR0*a* is pulled frontward, the retention arms 107 and 107 are elastically deformed and released from the retention recess portions 44*a* and 44*a* before the latch portions 116 and 116 are released from the hook portions 206 and 207. That is, the tray body TR0*a* leaves the reception portion 103 of the front cover 101 frontward in a state where the front cover 101 has been retained on the frames 201 and 202.

In FIG. 9 to FIG. 11, when the tray body TR0*a* rotates to the manual feed position, the tray cover 41 rotates around the rotation shaft 14*a*. In addition, the inner tray portion 31 rotates around the rotation shaft 16*a* located above the rotation shaft 14*a*. That is, in the tray body TR0*a* in Example 1, the tray portion 31 is opened moving along the inner side surface of the tray cover 41 due to the deviation between the rotation center of the tray portion 31 and the rotation center of the tray cover 41. On this occasion, the stopper shafts 36 and 37 of the tray portion 31 move toward the rotation shaft 16*a* along the guide holes 42*a* and 43*b* of the tray cover 41.

Here, when the tray body TR0*a* leaves the reception portion 103, the latch arm 46 is separated from the latch releasing portion 108. Thus, the pushing spring 47 which has been pushed by the latch releasing portion 108 is elastically recovered so that the latch arm 46 moves to a restriction position shown in FIG. 10 and FIG. 11. Accordingly, in FIG. 9 to FIG. 11, when the left stopper shaft 36 moves toward the rotation shaft 16*a* along the guide hole 42*b* as soon as the tray body TR0*a* is opened, the stopper shaft 36 contacts with the shaft restriction portion 46*a* of the latch arm 46 as shown in FIG. 11. Thus, the rotation of the tray portion 31 is restricted while the rotation of the tray cover 41 is restricted. As a result, the tray body TR0*a* is retained at an inclination angle set in advance with respect to the conveyance portion TR0*b*. That is, the tray body TR0*a* is retained in the manual feed position shown in FIG. 4, FIG. 11 and so on as an example of a second opening position. When the recording sheet S is loaded on the tray body TR0*a* retained in the manual feed position, the recording sheet S can be supplied from the tray body TR0*a* to the apparatus body U1 in a so-called manual feed mode.

When the recording sheet S supplied in the manual feed mode is jammed in the conveyance portion TR0*b* or the like, or when the manual feed unit U2 is maintained or inspected in accordance with deterioration over time or some failure, the operator can remove the manual feed unit U2 manually. In Example 1, when the tray body TR0*a* retained in the manual feed position is pulled out frontward, the work of removing the manual feed unit U2 can be carried out. That is, when the tray body TR0*a* is pulled out frontward, the conveyance portion TR0*b* mounted on the mounting portion 211 is pulled out along the guide portions 214 and 215, and pulled out to the outside through the attachment/detachment port 106 as shown in FIG. 5. Thus, the conveyance members TR0*c*, Ra and Ra of the conveyance portion TR0*b* are released from nipping. In addition, the mounting portion 211 is opened to the outside through the attachment/detachment port 106. Thus, the recording sheet S etc. jammed in the mounting portion 211 or the like can be removed from the outside. In addition, each component of the manual feed unit U2 can be maintained and inspected easily.

Incidentally, in the manual feed unit U2, the detachment portion 52*a* of the support slit 52 moves to the position of the boss 111 when the tray cover 41 moves to the manual feed position. When the tray body TR0*a* is pulled out frontward, the boss 111 passes the detachment portion 52*a* and leaves the support slit 52. That is, the tray body TR0*a* is separated from the front cover 101. On this occasion, the front cover 101 is retained on the frames 201 and 202 in a state where the latch portions 116 and 116 have been hooked on the hook portions 206 and 207, as shown in FIG. 6.

In FIG. 5 and FIG. 4, when the manual feed unit U2 is attached to the apparatus body U1, the conveyance portion TR0*b* is inserted into the attachment/detachment port 106 of the front cover 101. When the tray body TR0*a* is then pushed toward the inside of the apparatus body U1, the conveyance portion TR0*b* is inserted along the guide portions 214 and 215. When the positioned portions 17 and 17 are inserted into the positioning portions 212 and 213 and positioned thereby, the conveyance portion TR0*b* is mounted on the mounting portion 211. In addition, the attachment/detachment port 106 is closed by the conveyance portion TR0*b*. Further, the boss 111 passing the detachment portion 52*a* and entering the support slit 52 is supported by the support slit 52. When the tray body TR0*a* is then rotated to close the reception portion 103, the retention arms 107 and 107 are hooked on the retention recess portions 44*a* and 44*b*. Thus, the tray body TR0*a* is retained in the manual feed closing position shown in FIG. 3.

In FIG. 3 and FIG. 12, when the toner cartridges Ty to Tk are replaced, or when the apparatus body U1 is maintained and inspected, the operator opens the front cover 101 frontward. That is, for example, when the operator grips the operation recess portions 118 of the front cover 101 and pulls the front cover 101 with a force stronger than the force with which the latch portions 116 and 116 are hooked on the hook portions 206 and 207, the latch portions 116 and 116 are released from the hook portions 206 and 207.

Here, in the front cover 101, the tray body TR0*a* is received in the reception portion 103 in a state where the tray cover 41 of the manual feed unit U2 has been retained by the retention arms 107 and 107. In addition, in FIG. 21A, the boss 111 of the front cover 101 is supported in a state where the boss 111 has been fitted to the support slit 52 of the tray cover 41. That is, the front cover 101 can move together with the tray cover 41. Thus, when the front cover 101 is pulled frontward, the front cover 101 rotates around the rotation shaft 14*a* of the tray cover 41 so that the front cover 101 can be opened together with the tray body TR0*a*.

Thus, also when the front cover 101 is opened, the stopper shafts 36 and 37 move along the guide holes 42*b* and 43*b* in the tray body TR0*a*. Here, when the front cover 101 is opened, the tray body TR0*a* is received in the reception portion 103. Thus, the latch releasing portion 108 retains the latch arm 46 in the retracted position. Accordingly, in FIG. 9 to FIG. 11 and FIG. 16, when the stopper shafts 36 and 37 move along the guide holes 42*b* and 43*b*, movement of the stopper shafts 36 and 37 is not restricted by the latch arm 46. As a result, when the front cover 101 is opened, the stopper shafts 36 and 37 contact with end portions 42*b*1 and 43*b*1 of the guide holes 42*b* and 43*b* as shown in FIG. 16.

On this occasion, as shown in FIG. 12 and FIG. 16, the tray portion 31 and the tray cover 41 stop in a substantially horizontal direction. Thus, the tray body TR0*a* and the front cover 101 are retained in the working position in which the inside of the front surface of the apparatus body U1 is opened, as shown in FIG. 12, FIG. 16 and so on. The working position is an example of a first open position, and an example of an open position. Thus, the operator can replace the toner cartridges Ty to Tk from the upper side or the front side of the apparatus body U1. Incidentally, when the front cover 101 is opened, the switch pushing portion 118 is detached from the through hole 208. Thus, the interlock switch is actuated to stop the operation of the apparatus body U1.

In FIG. 3 and FIG. 12, in the printer U according to Example 1, when the toner cartridges Ty to Tk are replaced from the lower side of the apparatus body U1, or when the inside of the apparatus body U1 is opened to the outside, the operator can remove the removable unit U3 including the front cover 101 manually. In Example 1, when the front cover 101 retained in the working position is pulled out frontward, the work of removing the removable unit U3 can be carried out. That is, when the front cover 101 is pulled out frontward in FIG. 13 and FIG. 14, the part of the manual feed unit U2 is pulled out frontward from the apparatus body U1 through the boss 111 etc. That is, the part of the manual feed unit U2 is removed from the apparatus body U1 in the same manner as in the case of the manual feed unit U2 alone. Thus, working or the like inside the apparatus body U1 can be carried out.

In FIG. 15 to FIG. 12 and FIG. 3, when the movable unit U3 is attached to the apparatus body U1, the conveyance portion TR0*b* is inserted into the mounting portion 211, and the front cover 101 is pushed toward the apparatus body U1. As a result, the conveyance portion TR0*b* moves along the guide portions 214 and 215 so that the positioned portions 17 and 17 can be inserted into the positioning portions 212 and 213 and positioned thereby. That is, the conveyance portion TR0*b* is mounted on the mounting portion 211. When the front cover 101 is then rotated together with the tray body TR0*a* to close the front surface of the apparatus body U1, the latch portions 116 and 116 are hooked on the hook portions 206 and 207. That is, the front cover 101 and the tray body TR0*a* are retained in the closing position shown in FIG. 3.

Here, in the background-art configurations suggested in JP-A-2015-141228, JP-A-2011-248135 and JP-A-2006-337477, a lower end of an opening/closing member for opening/closing an opening portion through which toner cartridges are attached/detached is supported rotatably on a lower end of the opening portion. That is, the opening/closing member is unremovably supported on an apparatus body. When the opening/closing member is opened, the opening/closing member is opened to extend outward from the lower end of the opening portion. Accordingly, the operator can put his/her hand into the opening portion easily from the upper side or front side of the opening portion, but the opened opening/closing member makes it difficult for the operator to put his/her hand into the opening portion from the lower side of the opening portion. That is, in the background-art configuration, it is difficult for the operator to perform working with his/her hand extended from the lower side of the printer to the inside of the apparatus body. Accordingly, in the background-art configuration, it may be difficult for an operator who uses a wheelchair, an operator who is short, etc. to perform replacement of toner cartridges or maintenance and inspection inside a printer.

On the other hand, in the printer U according to Example 1, the front cover 101 can be removed. That is, in FIG. 12 to FIG. 14, when the front cover 101 arriving at the working position is pulled out frontward, the removable unit U3 including the front cover 101 can be removed from the apparatus body U1. Thus, in FIG. 14, the opening portion 204 as a whole is opened so that an operator can extend his/her hand to the inside of the opening portion 204 from the lower side of the opening portion 204.

As a result, the operator can extend his/her hand from the lower side of the opening portion 204 to pull out and remove the toner cartridges Ty to Tk frontward, or to insert and mount new toner cartridges Ty to Tk. Thus, according to Example 1, in accordance with the situation of the operator, the front cover 101 can be opened in the working position for the sake of working, or the removable unit U3 can be removed for the sake of working. Therefore, replacement work of toner cartridges or maintenance/inspection inside the apparatus body U1 can be performed easily regardless of the situation of an operator such as an operator who uses a wheelchair or an operator who is short.

Particularly the front cover 101 in Example 1 is supported on the manual feed unit U2 designed to be removably attached to the apparatus body U1 so that the front cover 101 can be removed. That is, in Example 1, the front cover 101 serves as a removable unit U3, which can be attached and detached together with the manual feed unit U2. An attachment/detachment mechanism for the front cover 101 is shared with an attachment/detachment mechanism for the manual feed unit U2. Accordingly, in Example 1, the configuration of the printer U can be simplified easily in comparison with a case where attachment/detachment mechanisms are provided for the front cover 101 and the manual feed unit U2 respectively.

In addition, in the background-art configuration, an opening/closing member for opening the inside of an apparatus body is supported directly on the apparatus body. That is, an opening/closing mechanism constituted by a shaft for rotating the opening/closing member, a support portion for the shaft, etc. is provided between the opening/closing member and the apparatus body. Here, particularly during conveyance, the apparatus body may touch an obstacle or fall down to suffer an impact. In the apparatus body suffering an impact, the opening/closing mechanism may be distorted so that the opening/closing member cannot be opened and closed easily. Accordingly, in the background art, strength is generally secured in the opening/closing member or the apparatus body in order to strengthen the opening/closing mechanism. Thus, the total cost of the apparatus is apt to increase. In addition, when another opening/closing member for replacing cartridges and a manual feed tray are provided, the number of opening/closing mechanisms to be installed increases. Thus, the cost is apt to further increase. In addition, when the number of opening/closing mechanisms to be installed increases, the configuration is apt to be complicated, and it is necessary to adjust the positional relationship among shafts or secure a plurality of rotation spaces. Therefore, design limitations are apt to increase.

On the other hand, in the removable unit U3 according to Example 1, the front cover 101 for opening the inside of the apparatus body U1 is supported on the tray body TR0*a* of the manual feed unit U2. That is, the boss 111 is supported in the support slit 52 of the tray cover 41, and the tray cover 41 is retained in the reception portion 103 through the retention arms 107 and 107, so that the front cover 101 can be supported on the tray body TR0*a*. The front cover 101 is opened and closed with the rotation shaft 14*a* of the tray body TR0*a* of the manual feed unit U2 as a rotation center. That is, in Example 1, the opening/closing mechanism for the front cover 101 is shared with the opening/closing mechanism for the manual feed unit U2.

Accordingly, in Example 1, the front cover 101 is opened and closed using the opening/closing mechanism for the manual feed unit U2. Here, in the background art, strength has been secured in the opening/closing mechanism for the manual feed unit U2. In Example 1, it is therefore unnecessary to secure strength for the opening/closing mechanism for the front cover 101. Thus, in Example 1, increase in total cost of the apparatus is suppressed. In addition, in Example 1, the number of opening/closing mechanisms to be installed is suppressed so that the total configuration can be simplified. Further, necessity to adjust the positional relationship among shafts or secure a plurality of rotation spaces is reduced so that design limitations cannot increase easily.

Further, according to the background-art configuration, there is a manufacturing error or an assembling error between a manual feed unit and an apparatus body when an opening/closing cover and a manual feed unit are provided. In addition, there is also a manufacturing error or an assembling error between the opening/closing cover and the apparatus body. Accordingly, in order to secure positional accuracy between a cover for the manual feed unit and the opening/closing cover, it is necessary to secure positional accuracy between the manual feed unit and the apparatus body while securing positional accuracy between the opening/closing cover and the apparatus body. That is, in the background-art configuration, a plurality of parts where positional accuracy should be secured are produced so that errors can be accumulated easily. When errors are accumulated, the opening/closing cover is not flush with the cover external surface of the manual feed unit. Thus, there may occur a step. That is, there may occur a positional deviation on appearance. On the other hand, in Example 1, the front cover 101 is positioned by the manual feed unit U2. Accordingly, in Example 1, accumulated errors can be reduced in comparison with that in the background art. Thus, the positional deviation on appearance between the front cover 101 and the manual feed unit U2 is suppressed. That is, in Example 1, matching on appearance between the front cover 101 and the manual feed unit U2 is improved in comparison with that in the background art.

(Modifications)

Although an example of the invention has been described in detail, the invention is not limited to the example, but various modifications can be made within the gist of the invention stated in the claims. Modifications (H01) to (H04) of the invention will be shown below by way of example.

(H01) Although the printer U is shown as an image forming apparatus in the aforementioned example by way of example, the invention is not limited thereto. The apparatus may be a facsimile apparatus, a copying machine, or a composite machine having all of those functions or some of the functions. In addition, the apparatus is not limited to a color image forming apparatus, but may have a configuration as a monochromatic image forming apparatus.

(H02) Although the configuration in which the front cover 101 as an example of a first opening/closing member is rotatably supported on the tray body TR0*a* as an example of a second opening/closing member is shown in the aforementioned example by way of example, the invention is not limited thereto. For example, the invention can be also applied to the paper feed tray TR1 for supplying the recording sheet S to the apparatus body U1. In addition, the invention can be also applied to an inversion unit as a conveyance path through which the recording sheet S having an image recorded thereon is sent again to the image recording area.

(H03) Although the front cover 101 having a configuration for replacing components such as the toner cartridges Ty to Tk is shown as an example of an opening/closing member in the aforementioned example by way of example, the invention can be also applied to an opening/closing member for opening a conveyance path in order to remove paper jam.

(H04) In the aforementioned example, the configuration in which the support slit 52 as an example of a support portion includes the detachment portion 52*a* is shown by way of example, and the configuration in which the boss 111 of the front cover 101 can be detached from the detachment portion 52*a* of the manual feed unit U2 is shown byway of example. However, the invention is not limited thereto. For example, the invention may be applied to a configuration in which the detachment portion 52*a* is removed, and the support slit 52 is a long hole whose opposite ends are closed. The invention may be also applied to a configuration in which the boss 111 of the front cover 101 cannot be detached from the support slit 52 of the manual feed unit U2.

(H05) In the aforementioned example, the configuration in which the tray body TR0*a* as an example of a second opening/closing member can be removably attached to the apparatus body U1 as the manual feed unit U2 is shown by way of example. The invention is not limited thereto. The tray body TR0*a* may be designed not to be removably attached, but the tray body TR0*a* may have a configuration in which it is supported rotatably on the apparatus body U1.

What is claimed is:

1. An image forming apparatus comprising:

a first opening/closing member that can move between a first opening position in which the first opening/closing member opens an inside of a body of the image forming apparatus, and a first closing position in which the first opening/closing member closes the inside of the body of the image forming apparatus;

a second opening/closing member that can move around a rotation shaft and between a second closing position in which the second opening/closing member closes an opening formed in the first opening/closing member, and a second opening position in which the second opening/closing member opens the opening, the second opening/closing member being removably attached to the body of the image forming apparatus; and a supported portion that is provided in the first opening/closing member so as to be supported on a support portion of the second opening/closing member, the supported portion being engaged with the support portion in the first opening position so that the first opening/closing member can move in a horizontal direction of the body of the image forming apparatus together with the second opening/closing member.

2. The image forming apparatus according to claim 1, further comprising: a detachment portion that is formed in the support portion so that the supported portion can be detached from the support portion when the first opening/closing member is retained in the first closing position and the second opening/closing member moves in a direction to leave the body of the image forming apparatus.

3. The image forming apparatus according to claim 1, wherein the second opening/closing member is constituted by a loading portion on which a medium can be loaded and that can move around the rotation shaft and between the second closing position in which the loading portion is received in the body of the image forming apparatus, and the second opening position in which the loading portion has rotated from the second closing position in order to load a medium on the loading portion.

4. The image forming apparatus according to claim 2, wherein the second opening/closing member is constituted by a loading portion on which a medium can be loaded and that can move around the rotation shaft and between the second closing position in which the loading portion is received in the body of the image forming apparatus, and the second opening position in which the loading portion has rotated from the second closing position in order to load a medium on the loading portion.

5. The image forming apparatus according to claim 1, wherein the inside the body of the image forming apparatus removably supports a replaceable component when the first opening/closing member is in the first opening position.

6. The image forming apparatus according to claim 2, wherein the inside the body of the image forming apparatus removably supports a replaceable component when the first opening/closing member is in the first opening position.

7. The image forming apparatus according to claim 3, wherein the inside the body of the image forming apparatus removably supports a replaceable component when the first opening/closing member is in the first opening position.

8. The image forming apparatus according to claim 4, wherein the inside the body of the image forming apparatus removably supports a replaceable component when the first opening/closing member is in the first opening position.

9. An image forming apparatus, comprising:

a loading member comprising a base portion that is supported on a body of the image forming apparatus, a loading portion that is supported movably around a rotation shaft relatively to the base portion and on which a medium can be loaded, and a support portion that is provided in the loading portion; and an opening/closing member that comprises a supported portion supported on the support portion and that can move around the rotation shaft of the loading portion and between an opening position in which the opening/closing member opens an inside of the body of the image forming apparatus, and a closing position in which the opening/closing member closes the inside of the body of the image forming apparatus, wherein the supported portion is a rigid body immovable with respect to the opening/closing member.

10. The image forming apparatus according to claim 9, wherein the loading member is constituted by a manual feed unit that includes the base portion including a guide portion guiding a medium, and that is removably attached to the body of the image forming apparatus.

11. The image forming apparatus according to claim 9, wherein:

the supported portion has a protruding shape; and the support portion has a groove-like shape that can support the supported portion.

12. The image forming apparatus according to claim 10, wherein:

the supported portion has a protruding shape; and the support portion has a groove-like shape that can support the supported portion.

13. The image forming apparatus according to claim 9, wherein:

the support portion can be engaged with and separated from the supported portion; and when the opening/closing member is in the closing position, the support portion is engaged with and separated from the supported portion so that the loading member can be attached to and removed from the body of the image forming apparatus.

14. The image forming apparatus according to claim 10, wherein:

the support portion can be engaged with and separated from the supported portion; and when the opening/closing member is in the closing position, the support portion is engaged with and separated from the supported portion so that the loading member can be attached to and removed from the body of the image forming apparatus.

15. The image forming apparatus according to claim 11, wherein:

the support portion can be engaged with and separated from the supported portion; and when the opening/closing member is in the closing position, the support portion is engaged with and separated from the supported portion so that the loading member can be attached to and removed from the body of the image forming apparatus.

16. The image forming apparatus according to claim 12, wherein:

the support portion can be engaged with and separated from the supported portion; and when the opening/closing member is in the closing position, the support portion is engaged with and separated from the supported portion so that the loading member can be attached to and removed from the body of the image forming apparatus.

17. The image forming apparatus according to claim 1, wherein the supported portion is a rigid body immovable with respect to the first opening/closing member.

18. The image forming apparatus according to claim 1, wherein the support portion has an opening that faces the inside of the image forming apparatus when the second opening/closing member is in a closed position.

19. An image forming apparatus, comprising:

a loading member comprising a base portion that is supported on a body of the image forming apparatus, a loading portion that is supported movably around a rotation shaft relatively to the base portion and on which a medium can be loaded, and a support portion that is provided in the loading portion; and an opening/closing member that comprises a supported portion supported on the support portion and that can move around the rotation shaft of the loading portion and between an opening position in which the opening/closing member opens an inside of the body of the image forming apparatus, and a closing position in which the opening/closing member closes the inside of the body of the image forming apparatus, wherein the support portion has an opening that faces the inside of the image forming apparatus when the loading member is in a closed position.

* * * * *